US005316903A

United States Patent [19]

Tomiyama

[11] Patent Number: 5,316,903

[45] Date of Patent: * May 31, 1994

[54] SILVER HALIDE COLOR PHOTOGRAPHIC MATERIAL

[75] Inventor: Hideki Tomiyama, Minami-ashigara, Japan

[73] Assignee: Fuji Photo Film Co., Ltd., Kanagawa, Japan

[ * ] Notice: The portion of the term of this patent subsequent to Mar. 29, 2011 has been disclaimed.

[21] Appl. No.: 745,259

[22] Filed: Aug. 14, 1991

[30] Foreign Application Priority Data

Aug. 16, 1990 [JP] Japan ..... 2-216378

[51] Int. Cl.[5] ..... G03C 1/34; G03C 1/38; G03C 7/392

[52] U.S. Cl. ..... 430/546; 430/551; 430/552; 430/553; 430/556; 430/557; 430/567; 430/631; 430/638

[58] Field of Search ..... 430/545, 546, 607, 613, 430/614, 624, 551, 552, 553, 556, 557, 567, 631, 638

[56] References Cited

U.S. PATENT DOCUMENTS

| | | | |
|---|---|---|---|
| 4,239,851 | 12/1980 | Aoki et al. | 430/546 |
| 4,540,657 | 9/1985 | Krishnamurthy | 430/546 |
| 5,001,045 | 3/1991 | Furutachi et al. | 430/546 |
| 5,037,730 | 8/1991 | Aoki et al. | 430/553 |
| 5,057,408 | 10/1991 | Takahashi et al. | 430/546 |
| 5,200,307 | 4/1993 | Takahashi | 430/507 |

FOREIGN PATENT DOCUMENTS

| | | | |
|---|---|---|---|
| 0304067 | 2/1989 | European Pat. Off. . | |
| 58-45017 | 10/1983 | Japan . | |
| 61-4041 | 1/1986 | Japan . | |
| 61-39045 | 2/1986 | Japan . | |
| 62-75447 | 4/1987 | Japan . | |
| 62-129853 | 6/1987 | Japan . | |
| 62-172353 | 7/1987 | Japan . | |
| 62-196657 | 8/1987 | Japan . | |
| 64-21447 | 1/1989 | Japan . | |
| 64-50048 | 2/1989 | Japan . | |
| 64-50049 | 2/1989 | Japan . | |
| 921071 | 3/1963 | United Kingdom | 430/630 |
| 2015184 | 9/1979 | United Kingdom . | |

*Primary Examiner*—Lee C. Wright

*Attorney, Agent, or Firm*—Birch, Stewart, Kolasch & Birch

[57] ABSTRACT

There is disclosed a silver halide color photographic material which comprises a compound selected from the group consisting of sparingly water-soluble epoxy compounds represented by formula (I), (II), or (III) given below and a dye-forming coupler in a layer on a base.

Formula (I)

Formula (II)

Formula (III)

wherein $R^1$, $R^2$, and $R^3$ each represent an alkyl group or a halogen atom, $L^1$ and $L^2$ each represent a divalent aliphatic organic group, M represents an oxygen or nitrogen atom, A represents a polyvalent linking group, a, b, and c each are an integer of 0 to 4, x and y each are a real number of 0 to 20, l is 1 or 2, and m is an integer of 2 to 4.

36 Claims, No Drawings

SILVER HALIDE COLOR PHOTOGRAPHIC MATERIAL

FIELD OF THE INVENTION

The present invention relates to silver halide color photographic materials, and particularly to a silver halide color photographic material improved in preservability of the color image by using an epoxy compound that is sparingly water-soluble. More particularly the present invention relates to a silver halide color photographic material improved in fastness of the color image to light, heat, humidity, or acids and is prevented from increasing stain with long-term storage by using the above compound.

BACKGROUND OF THE INVENTION

When color photographic materials are stored as records semipermanently, the extent of light-fading and dark-fading should be suppressed as much as possible and the color balance of three-color-fading among the yellow, magenta, and cyan dye images should be retained as in the initial state. However, the extent of light-fading and dark-fading of the yellow, magenta, and cyan dye images differs from dye image to dye image, and after long-term storage, the color balance of three-color-fading is lost and the image quality of the dye images deteriorates.

Dark-fading of the yellow dye image and the cyan dye image in an environment high in humidity is greater than that of the magenta dye image, and the color balance is lost considerably in some cases. Further, when the photographic material is stored under such conditions, mold occurs on the photographic material surface and the cyan dye image and the yellow dye image are faded extremely by organic acids (e.g., acetic acid, citric acid, tartaric acid, and gluconic acid) secreted from the fungi, thereby leaving red spots in the image, for example, of a color print. Such a defect is often found in areas high in both temperature and humidity, for example, in the southern district of Japan (e.g., Okinawa and Shikoku), and in the case of important photographs which are desired to be preserved as records, such as wedding photographs, although a measure of laminating the photographs is taken, not only is the operation complicated and laborious, but deterioration of the image quality cannot be obviated anyway. Even if mold does not occur, when the pH of the surface of the produced photographic image is low due to the type or scatter of conditions of the development processing, bleach-fix processing, or stabilization processing, fading of the cyan dye image and the yellow dye image is also promoted.

To solve such problems, with respect to cyan dye images, for example, JP-B ("JP-B" means examined Japanese patent publication) No. 45017/1983 and JP-A ("JP-A" means unexamined published Japanese patent application) Nos. 75447/1987, 129853/1987, 172353/1987, 196657/1987, and 21447/1989, and with respect to yellow dye images, for example, JP-A Nos. 50048/1989, 50049/1989, and 4041/1986, disclose the use of cyclic ether compounds or epoxy-group-containing compounds, and although it is recognized that these compounds have an effect to a certain extent on the improvement of fastness to dark-fading and acid-fading, the improvement is still unsatisfactory, and in some cases there are injurious effects that fading or insufficient color restoration occurs due to the leuco dye formation of a cyan dye formed when the photographic material is processed in a bleach-fix bath containing an exhausted solution.

The cyan dye image obtained from phenol couplers having as a ballasting group a straight-chain or branched alkyl group, described in JP-A No. 39045/1986, is excellent in fastness to light and heat, but it has defects that it is poor in fastness to the above-mentioned acids and the unexposed part (white background) is colored cyan with long-term storage. A method for solving the latter problem by additionally using a certain epoxy compound is described in JP-A No. 21447/1989, but the method is insufficient for improvement in the former problem: acid-fading.

SUMMARY OF THE INVENTION

An object of the present invention is to provide a silver halide photographic material that is improved in fastness to dark-fading, light-fading, and acid-fading of the image dye with long-term storage, so that it can form a dye image that exhibits excellent image preservability.

Another object of the present invention is to provide a silver halide color photographic material that is improved, in particular, in fastness to dark-fading, light-fading, and acid-fading of the cyan dye image with long-term storage, and whose unexposed part, i.e., white background, is not colored cyan.

Other and further objects, features, and advantages of the invention will appear more fully from the following description.

DETAILED DESCRIPTION OF THE INVENTION

The inventors have made research into epoxy compounds, studied them in various ways, and have solved the above problems by using a sparingly water-soluble epoxy compound represented by the formula (I), (II), or (III) given below in combination with a dye-forming coupler.

That is, the present invention provides:

(1) A silver halide color photographic material which comprises in at least one photographic layer on a base at least one compound selected from the group consisting of sparingly water-soluble epoxy compounds represented by formula (I), (II), (III) given below and a dye-forming coupler.

Formula (I)

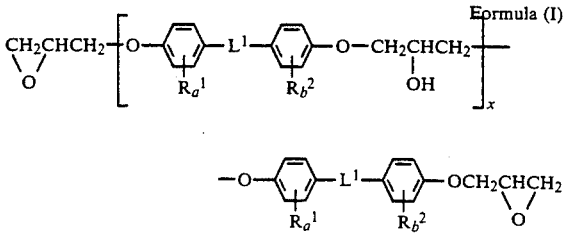

-continued

Formula (II)

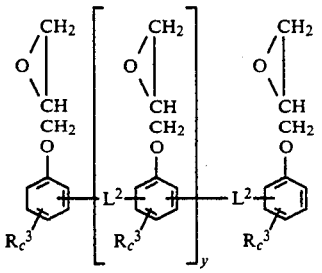

Formula (III)

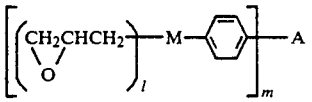

wherein $R^1$, $R^2$, and $R^3$ each represent an alkyl group or a halogen atom, $L^1$ and $L^2$ each represent a divalent aliphatic organic group, M represents an oxygen or nitrogen atom, A represents a polyvalent linking group, a, b, and c each are an integer of 0 to 4, x and y each are a real number of 0 to 20, l is 1 or 2, and m is an integer of 2 to 4.

(2) A silver halide color photographic material stated in above item (1), wherein the dye-forming coupler is a cyan coupler represented by the following formula (IV):

Formula (IV)

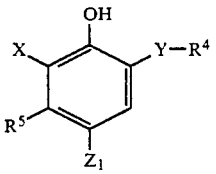

wherein Y represents —NHCO— or —CONH—, $R^4$ represents an aliphatic group, an aromatic group, a heterocyclic group, or an amino group, X represents a hydrogen atom, a halogen atom, an alkoxy group, or an acylamino group, $R^5$ represents an alkyl group or an acylamino group, or $R^5$ represents a group of nonmetallic atoms required to form a 5- to 7-membered ring by bonding with X, and $Z_1$ represents a hydrogen atom or a group capable of being released upon coupling reaction with the oxidized product of a color-developing agent.

(3) A silver halide color photographic material stated in above item (2), wherein the dye-forming coupler is a cyan coupler represented by the following formula (IVa):

Formula (IVa)

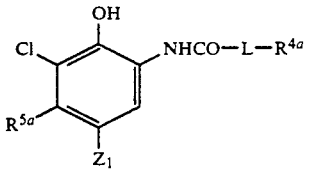

wherein $R^{4a}$ represents an alkyl group having at least 7 carbon atoms, $R^{5a}$ represents an alkyl group having 2 to 15 carbon atoms, L represents a mere bond or a divalent linking group, and $Z_1$ has the same meaning as defined in formula (IV).

(4) A silver halide color photographic material stated in above item (1), wherein the dye-forming coupler is a yellow coupler represented by the following formula (V):

Formula (V)

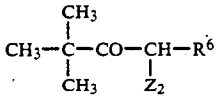

wherein $R^6$ represents an N-arylcarbamoyl group and $Z_2$ represents a group capable of being released upon coupling reaction with the oxidized product of an aromatic primary amine color-developing agent.

(5) A silver halide color photographic material stated in above item (1), wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and nonphotosensitive hydrophilic colloid layers are provided on a base, and at least one of said silver halide emulsion layers contains at least one compound selected from the group consisting of sparingly water-soluble epoxy compounds represented by formula (I), (II), or (III).

(6) A silver halide color photographic material stated in above item (1), wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and nonphotosensitive hydrophilic colloid layers are provided on a base, and at least one of said nonphotosensitive hydrophilic colloid layers contains at least one compound selected from the group consisting of sparingly water-soluble epoxy compounds represented by formula (I), (II), or (III).

(7) A silver halide color photographic material stated in above item (6), wherein the cyan dye-forming coupler is a compound represented by formula (IVa).

In the epoxy compound represented by formula (I), (II), or (III), more particularly $L^1$ and $L^2$ include, for example,

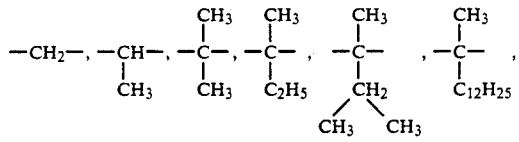

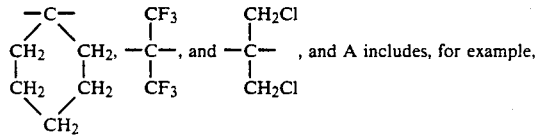

, and A includes, for example,

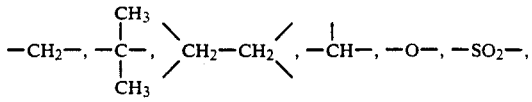

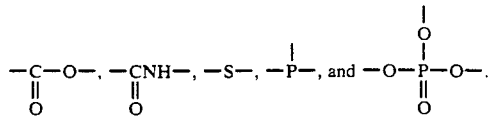

$R^1$, $R^2$, and $R^3$ in formula (I), (II), or (III) represent an alkyl group, which may be straight chain or branched chain, wherein the number of carbon atoms is not restricted (e.g., methyl, ethyl, propyl, butyl, decyl, and tridecyl) or a halogen atom (e.g., chlorine, bromine, and fluorine).

When the above epoxy compound is used in combination with a cyan coupler represented by formula (IV) or a yellow coupler represented by formula (V), the keeping quality of the cyan and yellow dye images can be improved.

In particular, when said epoxy compound is used in combination with a cyan coupler represented by formula (IVa), a color image can be obtained wherein dark-fading, light-fading, and acid-fading of the cyan dye image of a color photograph with long-term storage are improved and the white background of the unexposed part after the storage will not be colored cyan.

In formula (IVa), $R^{4a}$ represents an alkyl group having at least 7 carbon atoms (e.g., octyl, tert-octyl, tridecyl, pentadecyl, and eicosyl), preferably a straight-chain alkyl group having 10 to 22 carbon atoms. In formula (IVa), L represents a simple bond or a divalent linking group.

Herein the term "divalent linking group" includes alkylene, phenylene, an ether linkage, a carbonamido linkage, a sulfonamido linkage, an ester linkage, and a urethane linkage, and a divalent group formed by combining these groups, and examples of the combination are given below:

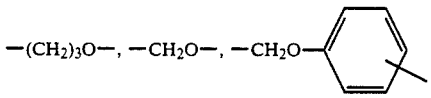

(any of o, m, and p is possible, the same being applied hereinafter)

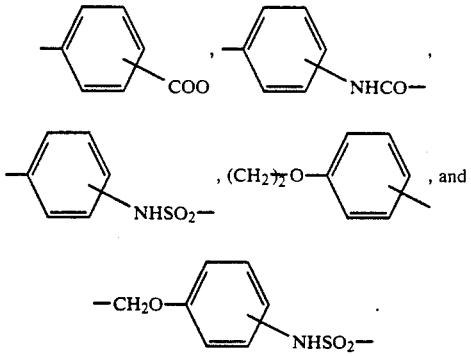

In formula (IVa), $R^{5a}$ represents an alkyl group having 2 to 15 carbon atoms (e.g., ethyl, butyl, tert-butyl, cyclohexyl, and pentadecyl), preferably an alkyl group having 2 to 4 carbon atoms, and most preferably an ethyl group.

In formula (IVa), $Z_1$ represents a hydrogen atom or a group capable of being released upon coupling reaction, such as a halogen atom (e.g., fluorine, chlorine, and bromine), an alkoxy group (e.g., ethoxy, dodecyloxy, methoxyethylcarbamoylmethoxy, carboxypropyloxy, methylsulfonyl, and ethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, heptafluorobutyrylamino, methanesulfonylamino, and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., ethylthio, phenylthio, and tetrazolylthio), an imido group (e.g., succinimido and hydantoinyl), and an aromatic azo group (e.g., phenylazo), which may contain a photographically useful group.

In formula (IVa), preferably $Z_1$ is a hydrogen atom and a halogen atom and, in particular, most preferably chlorine and fluorine.

The alkyl group, the aliphatic group, the aromatic group, and the linking group capable of substitution (e.g., alkylene and a phenyleneamido linkage) in formula (IVa) may further be substituted by a group selected from the group consisting of alkyl groups, aryl groups, heterocyclic groups, alkoxy groups (e.g., methoxy and 2-methoxyethoxy), aryloxy groups (e.g., 2,4-di-tert-amylphenoxy, 2-chlorophenoxy, and 4-cyanophenoxy), alkenyloxy groups (e.g., 2-propenyloxy), acyl groups (e.g., acetyl and benzoyl), ester groups (e.g., butoxycarbonyl, phenoxycarbonyl, acetoxy, benzoyloxy, butoxysulfonyl, and toluenesulfonyloxy), amido groups (e.g., acetylamino, ethylcarbamoyl, dimethylcarbamoyl, methanesulfonamido, and butylsulfamoyl), sulfamido groups (e.g., dipropylsulfamoylamino), imido groups (e.g., succinimido and hydantoinyl), ureido groups (e.g., phenylureido and dimethylureido), aliphatic or aromatic sulfonyl groups (e.g., methanesulfonyl and phenylsulfonyl), aliphatic or aromatic thio groups (e.g., ethylthio and phenylthio), a hydroxy group, a cyano group, a carboxy group, a nitro group, a sulfo group, and halogen atoms.

The cyan coupler represented by formula (IVa) may be used in combination with other cyan couplers represented by formula (IV).

Herein the term "sparingly water-soluble" means that the solubility in water at 25° C. is 10% or below, and the epoxy compound of the present invention is used by emulsifying and dispersing it together with or separately from the coupler into a hydrophilic binder, such as an aqueous gelatin solution using a surface-active agent. At that time, a high-boiling organic solvent that has a boiling point of 160° C. or over and that is sparingly soluble in water, or a low-boiling auxiliary organic solvent, may be used. Although the coupler and the epoxy compound that is sparingly soluble in water may be added to separate layers, preferably they are added to the same layer, in particular to the same oil droplets.

However, with respect to cyan couplers, if a cyan coupler represented by formula (IVa) is used, the epoxy compound that is sparingly water-soluble is preferably added to a nonphotosensitive hydrophilic layer separate from the layer containing the cyan coupler, for example to an intermediate layer (e.g., between a cyan coupler-containing layer and a magenta coupler-containing layer, or between a magenta coupler-containing layer and a yellow coupler-containing layer), to a layer between the undermost photosensitive silver halide emulsion layer and a base, to a surface-protective layer, or to a layer between a surface-protective layer and an uppermost photosensitive silver halide emulsion layer, in view of the prevention of the light-fading of the cyan dye.
Examples of the compounds represented by formulae (I), (II), and (III) that can be used in the present invention are specifically shown below, but the present invention is not restricted to them.
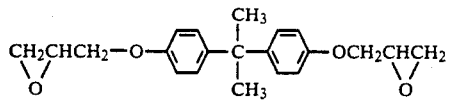
(I-1)
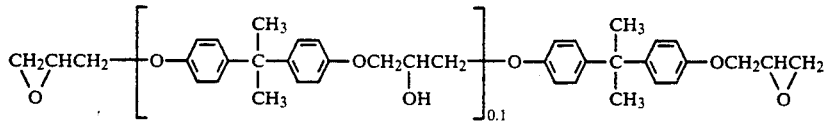
(I-2)
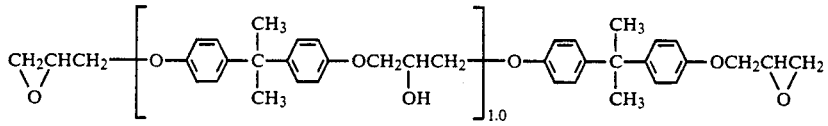
(I-3)
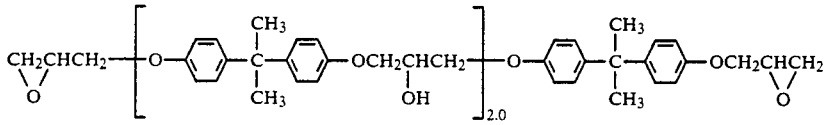
(I-4)
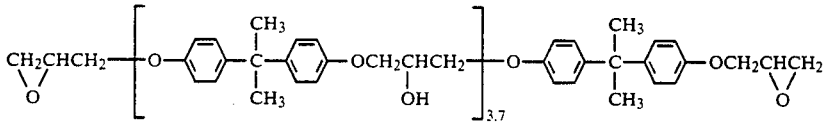
(I-5)
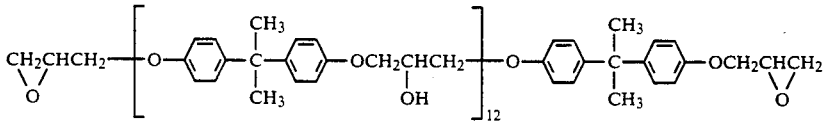
(I-6)
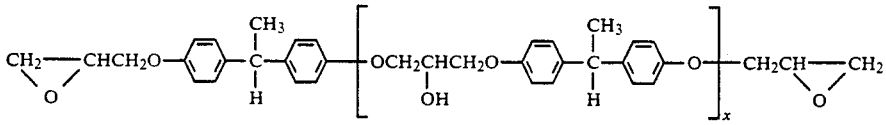
(I-7)
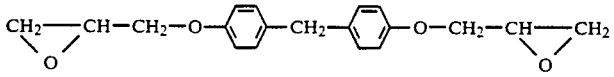
(I-8)
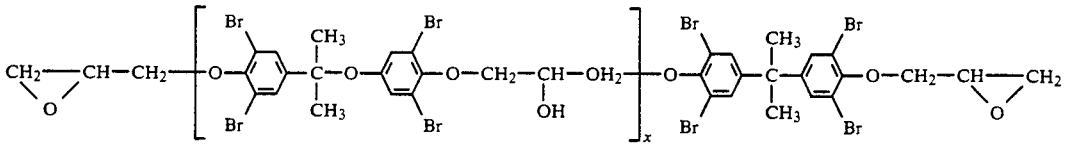
(I-9)
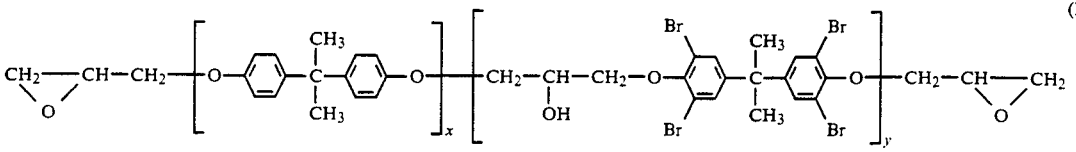
(I-10)

-continued
(I-11)
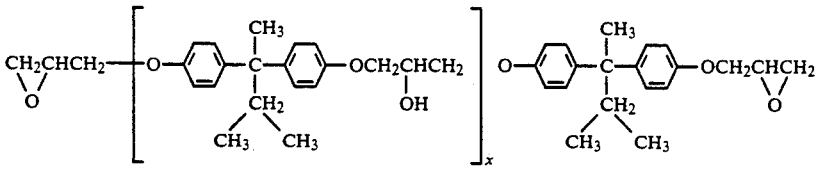
(I-12)
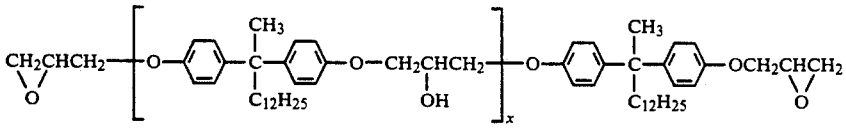
(I-13)
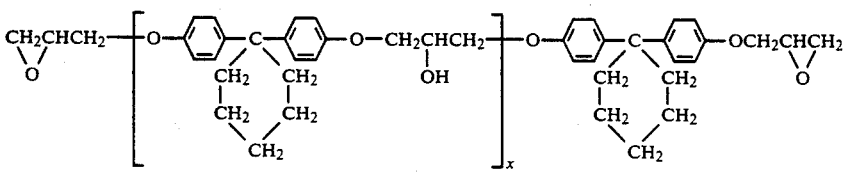
(I-14)
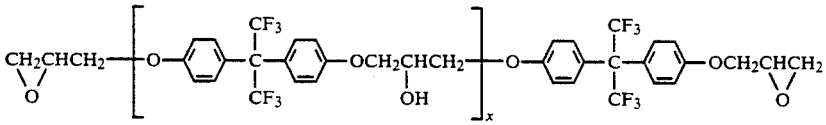
(II-1)
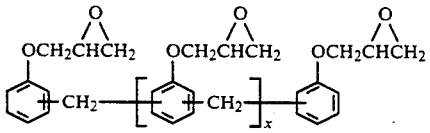
(II-2)
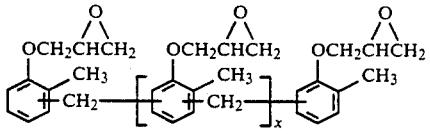
(II-3)
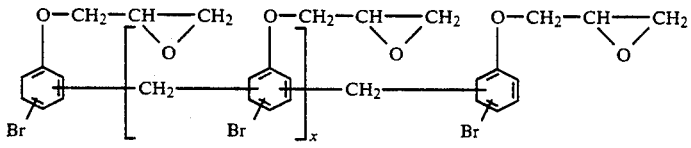
(III-1)
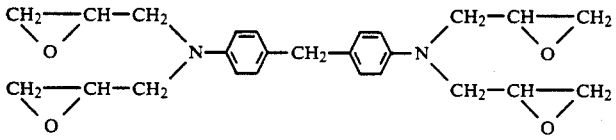
(III-2)
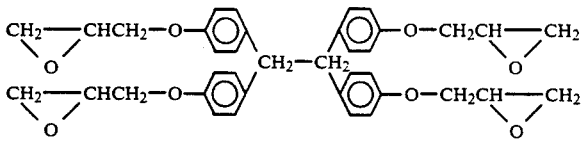
(III-3)
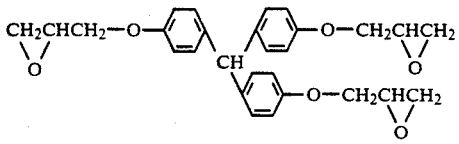

-continued

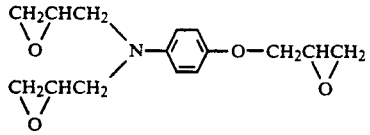

(III-4)

In the above structural formulae, the variable x is a real number and may be any real number in the range of 0 to 20. The reason why x is not necessarily an integer is that epoxy compounds having different integral values are mixed in a certain ratio and the variable x is the average value of the different integral values. These epoxy compounds may be used alone or as a mixture of two or more, or they may be used in combination, with a high-boiling organic solvent and/or a water-soluble and organic solvent-soluble polymer. Preferable examples of the high-boiling organic solvent and the polymer are those disclosed in JP-A No. 537/1989.

The above-mentioned epoxy resin used in the present invention is, for example, one obtained by reacting bisphenol A with epichlorohydrin in the presence of caustic soda (Naoshiro Ooishi, et al., *Purasuchikku Zairyo Koza* (5), *Epokishi Jushi,* Nikkan Kogyo Shinbunsha). As this epoxy resin, a commercially available one can be used, for example, Epikote (manufactured by Shell International Chemicals Corp.), Araldite (manufactured by Ciba Ltd.), Bakelite (manufactured by UCC), and DER (manufactured by Dow Chemical Co.) which are trade names.

Examples of the cyan coupler represented by formula (IV) are described in detail in JP-A No. 537/1984. Specific examples of the compound are shown below, but compounds of the present invention are not restricted to them.

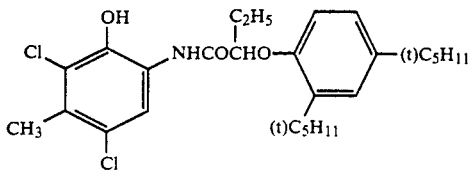

(C-1)

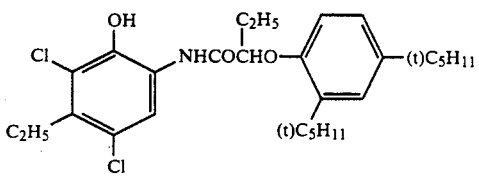

(C-2)

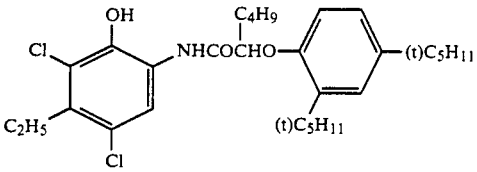

(C-3)

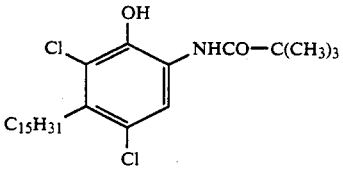

(C-4)

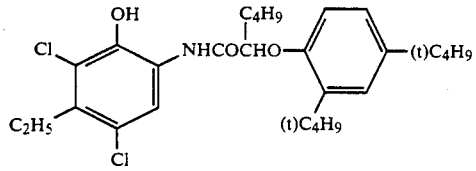

(C-5)

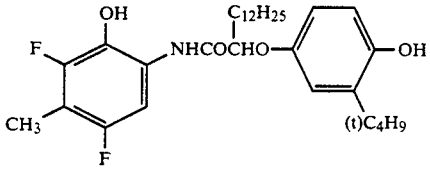

(C-6)

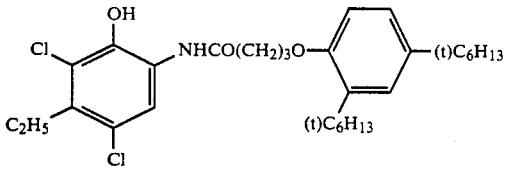

(C-7)

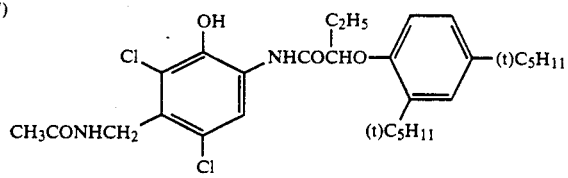

(C-8)

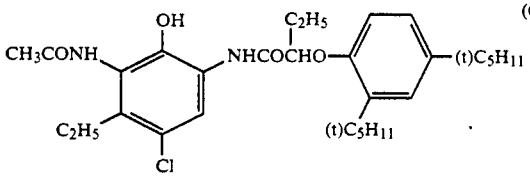

(C-9)

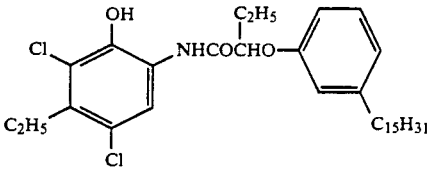

(C-10)

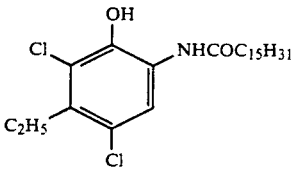

(C-11)

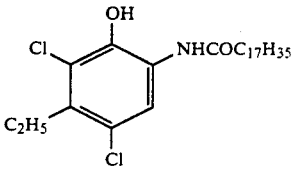

(C-12)

-continued
(C-13)
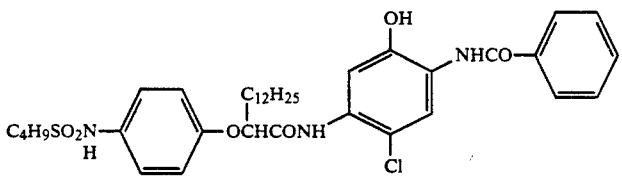
(C-14)
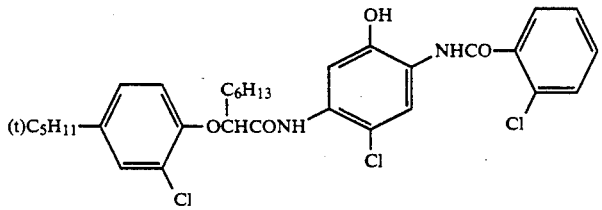
(C-15)
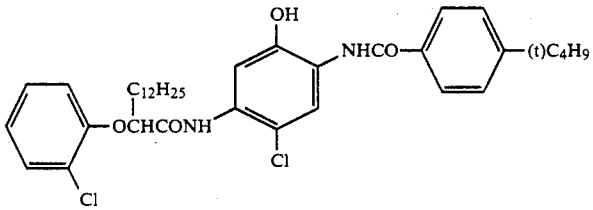
(C-16)
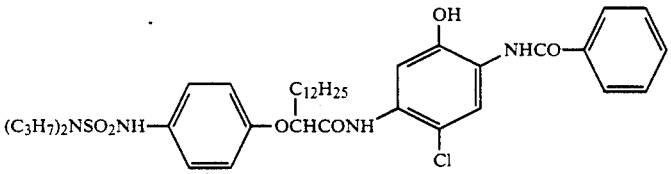
(C-17)
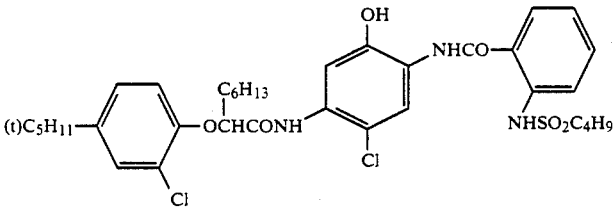
(C-18)
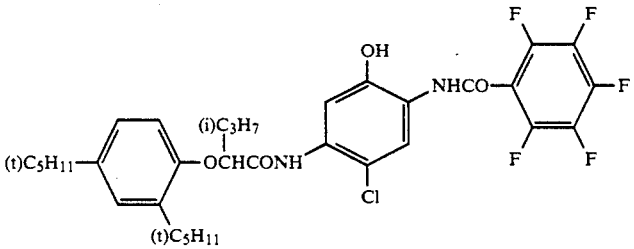
(C-19)
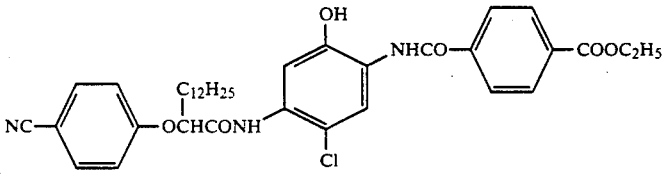

-continued
(C-20)
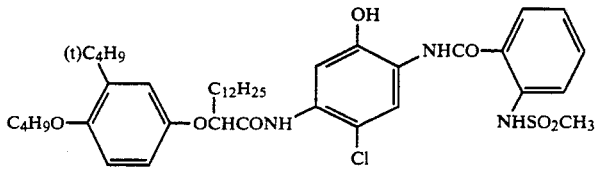
(C-21)
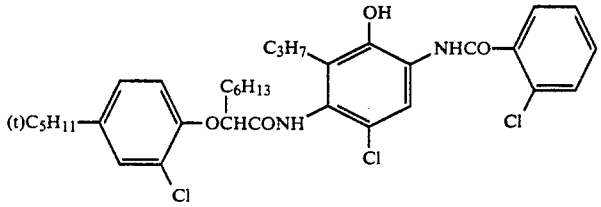
(C-22)
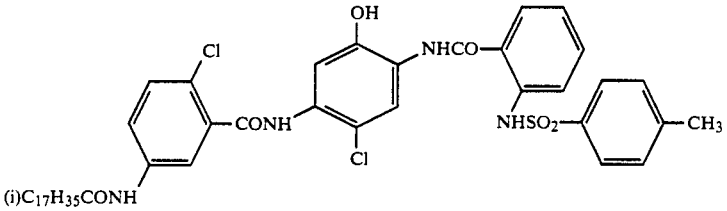
(C-23)
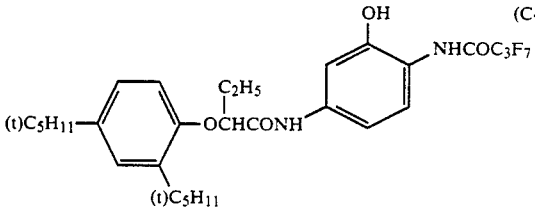
(C-24)
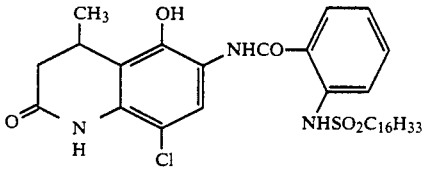
(C-25)
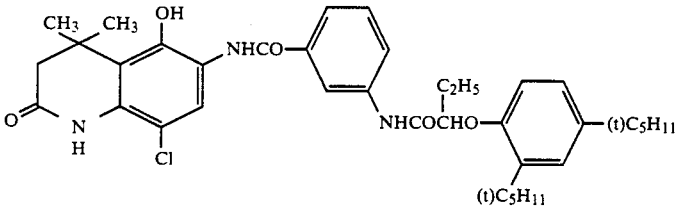
(C-26)
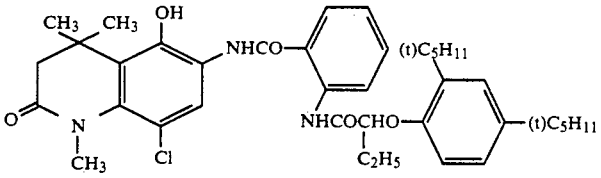
(C-27)
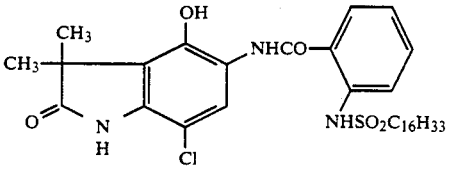

-continued
(C-28)
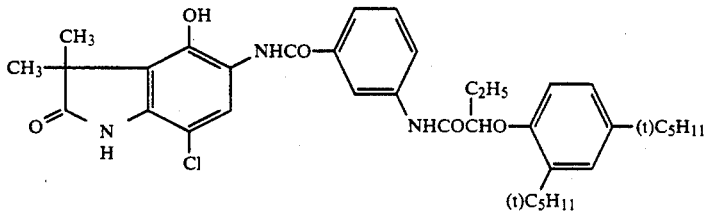
(C-29)
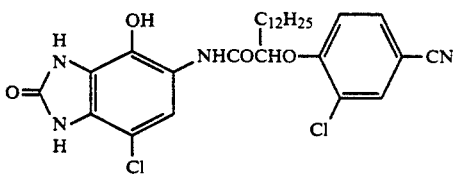
(C-30)
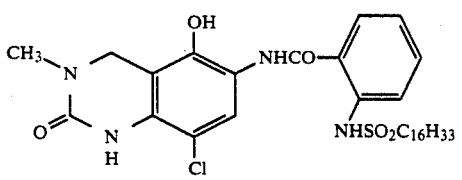
(C-31)
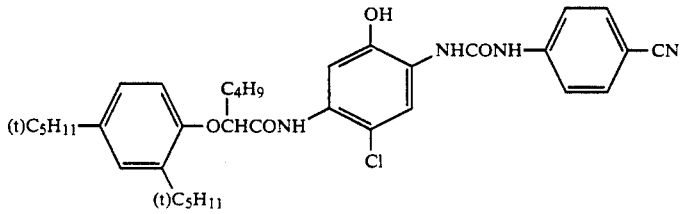
(C-32)
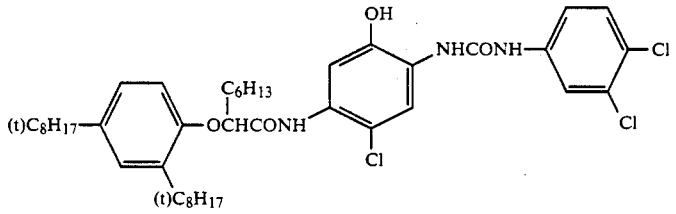
(C-33)
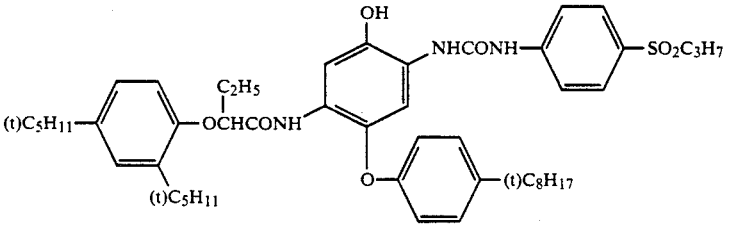
(C-34)
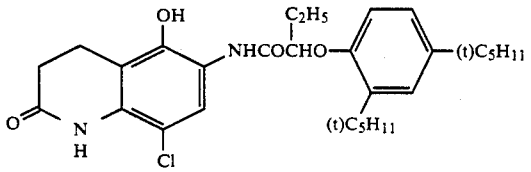
(C-35)
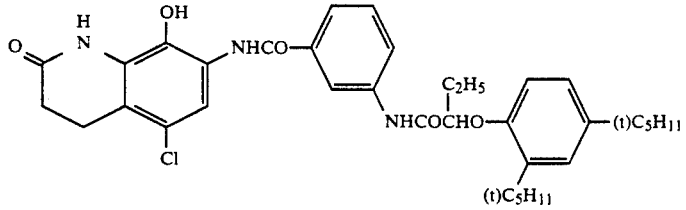

-continued
(C-36)
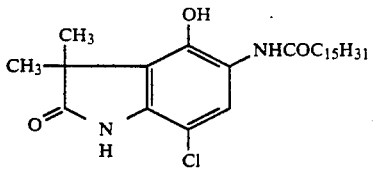
(C-37)
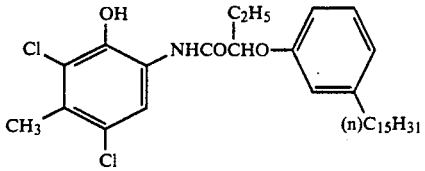
Each ratio of x/y/z or x/y shown below is represented in weight ratio.
(C-38)
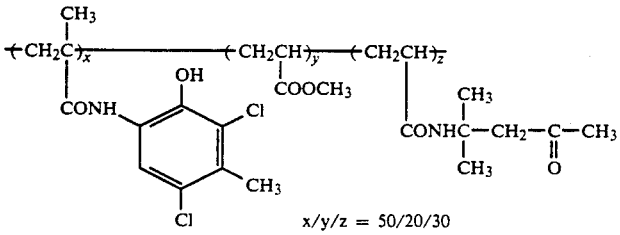
x/y/z = 50/20/30
(C-39)
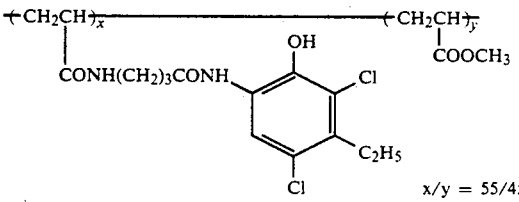
x/y = 55/45
(C-40)
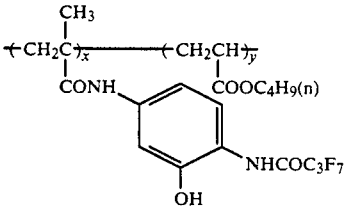
x/y = 60/40
(C-41)
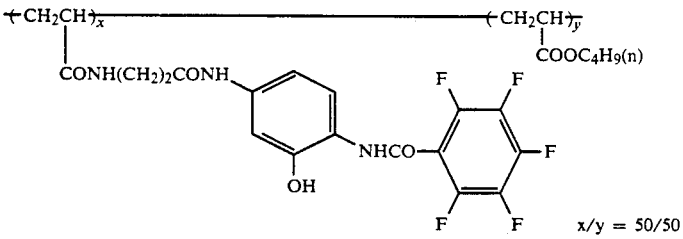
x/y = 50/50
(C-42)
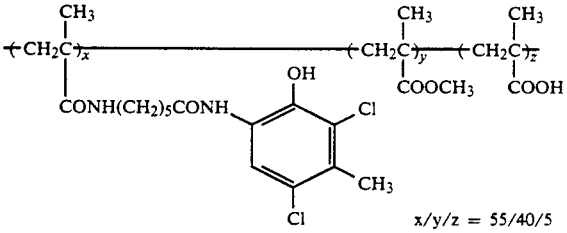
x/y/z = 55/40/5

-continued (C-43)

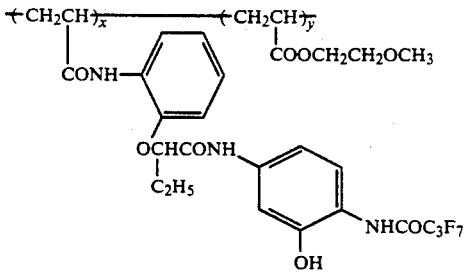

x/y = 60/40

(C-44)

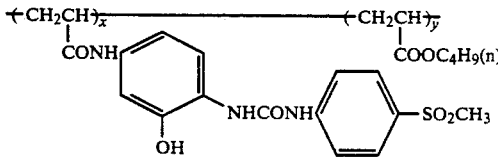

x/y = 50/50

(C-45)

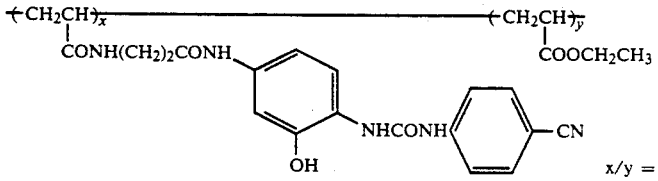

x/y = 45/55

(C-46)

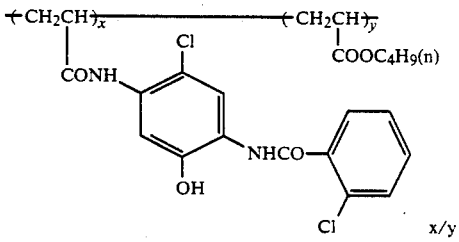

x/y = 50/50

In particular, specific examples of the cyan coupler represented by formula (IVa) include the below-mentioned IV-1 to IV-20, however the present invention is not restricted to them. Compound IV-3 is identical to C-11 mentioned above, IV-4 is identical to C-12 mentioned above, and IV-8 is identical to C-10 mentioned above.

| Compound | $R^{5a}$ | L | $R^{4a}$ | $Z_1$ |
|---|---|---|---|---|
| IV-1 | $C_2H_5$— | — | —$C_{11}H_{21}$(n) | Cl |
| IV-2 | " | " | —$C_{13}H_{27}$(n) | " |
| IV-3 | " | " | —$C_{15}H_{31}$(n) | " |
| IV-4 | " | " | —$C_{17}H_{35}$(n) | " |
| IV-5 | " | " | —$C_{21}H_{43}$(n) | " |
| IV-6 | " | —CH(OC$_2$H$_5$)— | —$C_{12}H_{25}$(n) | " |
| IV-7 | " | 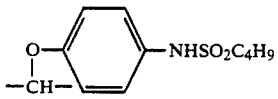 | " | " |
| IV-8 | " | 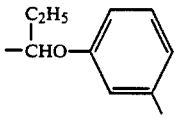 | —$C_{15}H_{31}$(n) | " |
| IV-9 | " | 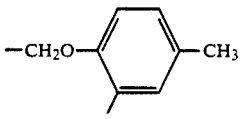 | —$C_{10}H_{21}$(n) | " |

-continued

| Compound | $R^{5a}$ | L | $R^{4a}$ | $Z_1$ |
|---|---|---|---|---|
| IV-10 | $(i)C_3H_7$— | — | $-C_{17}H_{33}(n)$ | " |
| IV-11 | $(n)C_4H_9$— | " | $-C_{15}H_{31}(n)$ | F |
| IV-12 | $(t)C_4H_9$— | " | $-C_{13}H_{27}(n)$ | Cl |
| IV-13 | $(n)C_{15}H_{31}$— | " | $-C_9H_{19}$ | " |
| IV-14 | $C_2H_5$— | 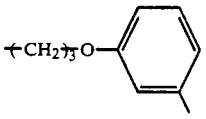 | $-C_{15}H_{31}$ | " |
| IV-15 | " | 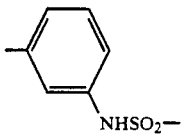 | $-C_{16}H_{33}(n)$ | " |
| IV-16 | " | 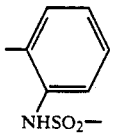 | $-C_{12}H_{25}(n)$ | " |
| IV-17 | " | " | $-C_{17}H_{35}(iso)$ | " |
| IV-18 | $(t)C_8H_{17}$— | " | $-CH(C_2H_5)C_4H_9$ | " |
| IV-19 | $C_2H_5$— | 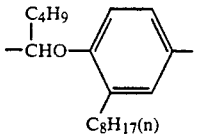 | $-C_8H_{17}(n)$ | " |
| IV-20 | " | 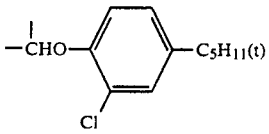 | " | " |

Examples of the yellow coupler represented by formula (V) are described, for example, in detail in JP-A Nos. 50049/1989 and 50048/1989. Specific examples of the compound are shown below, but compounds of the present invention are not restricted to them.

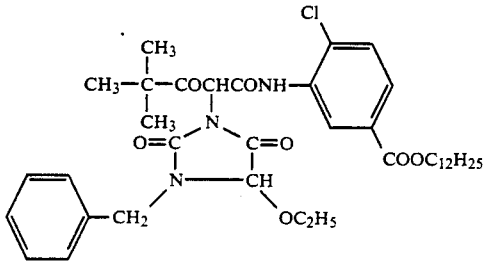

(Y-1)

-continued
(Y-2)
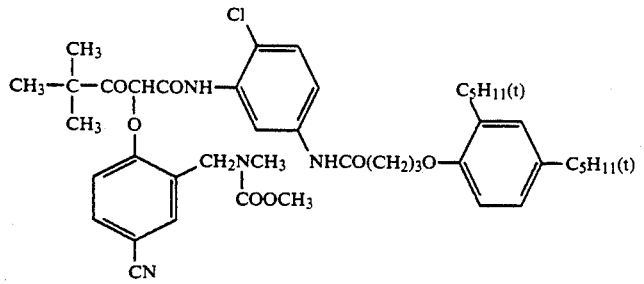
(Y-3)
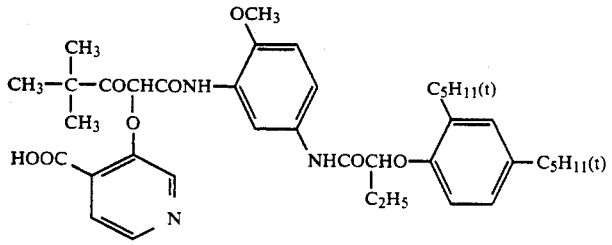
(Y-4)
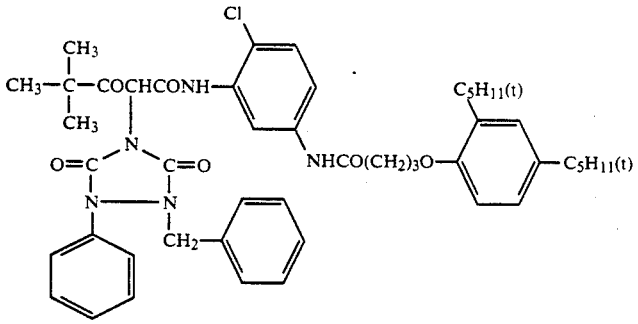
(Y-5)
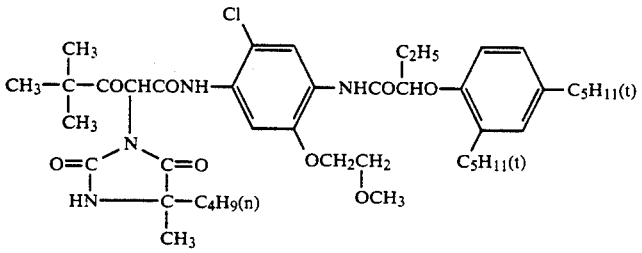
(Y-6)
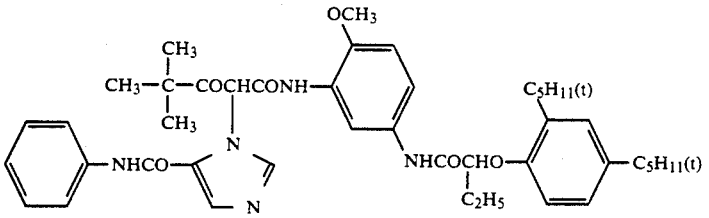

-continued
(Y-7)
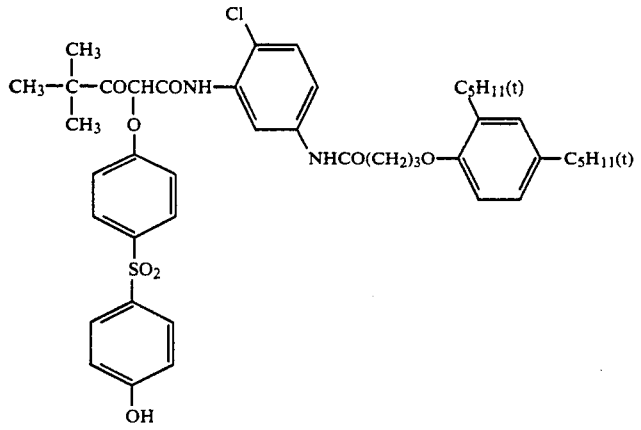
(Y-8)
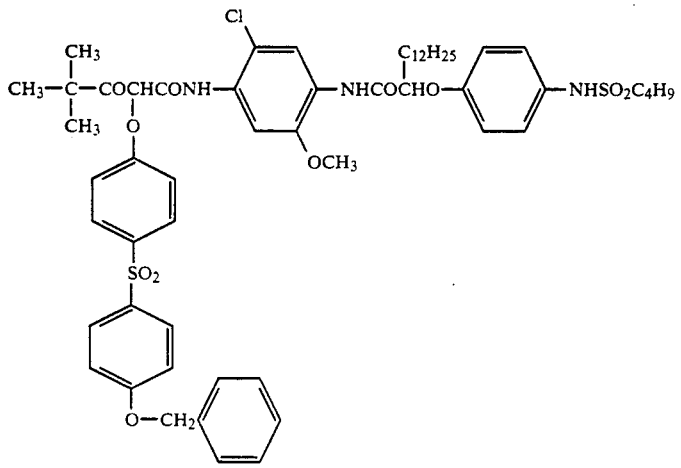
(Y-9)
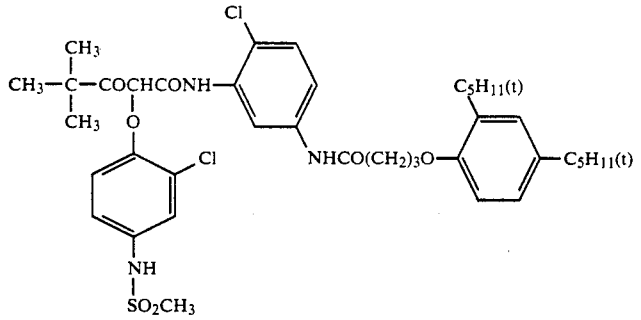
(Y-10)
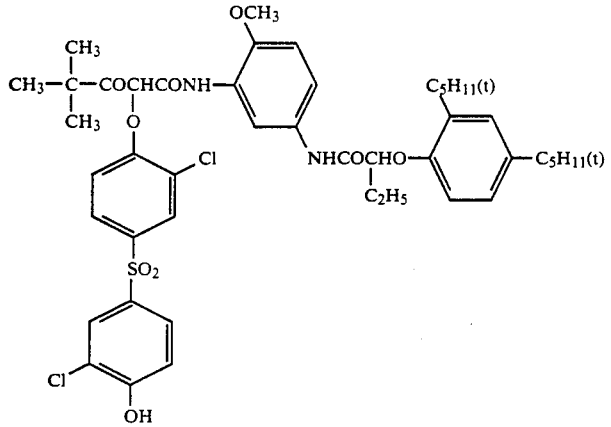

-continued
(Y-11)
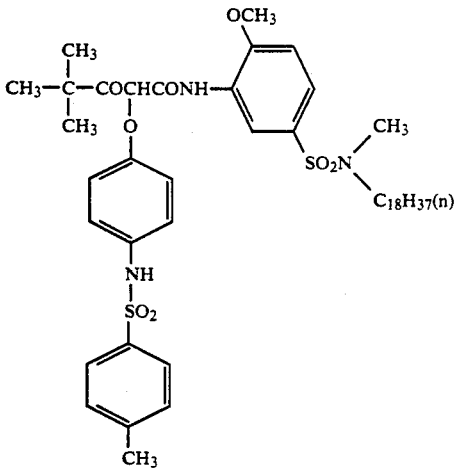
(Y-12)
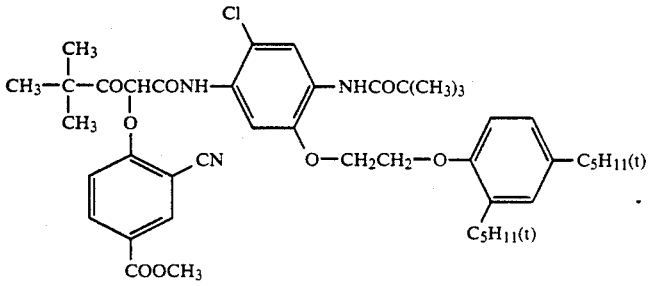
(Y-13)
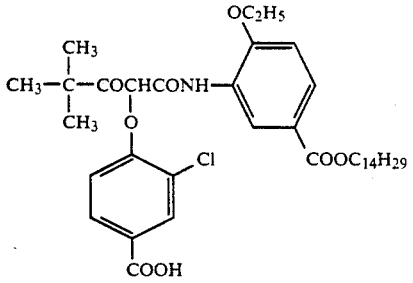
(Y-14)
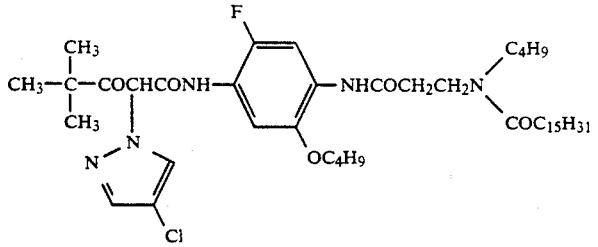
(Y-15)
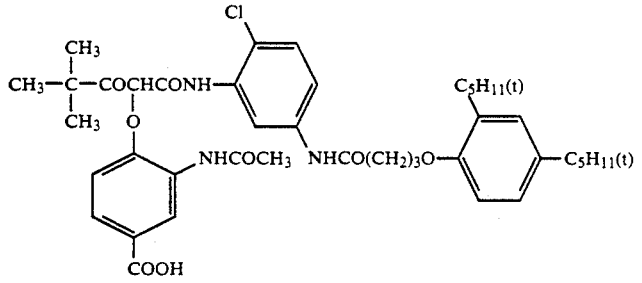

-continued
(Y-16)
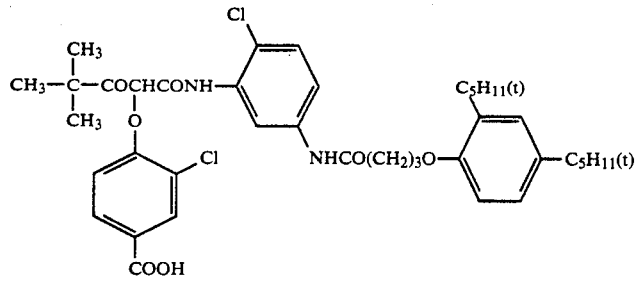
(Y-17)
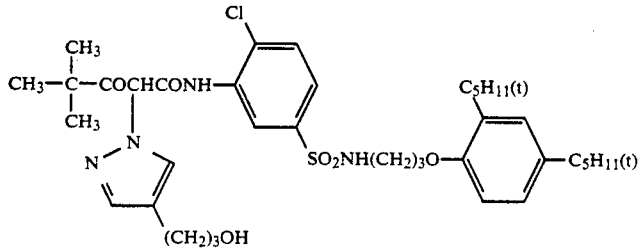
(Y-18)
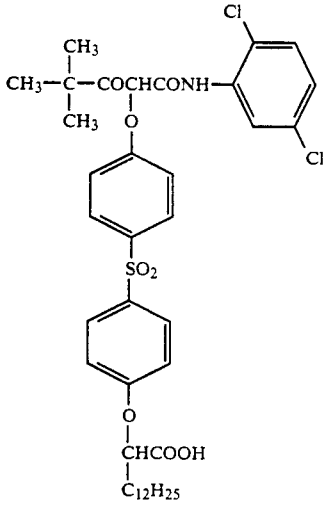
(Y-19)
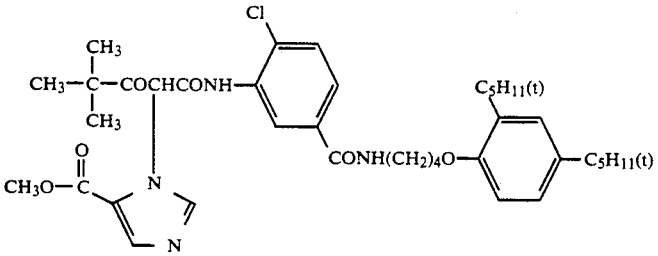
(Y-20)
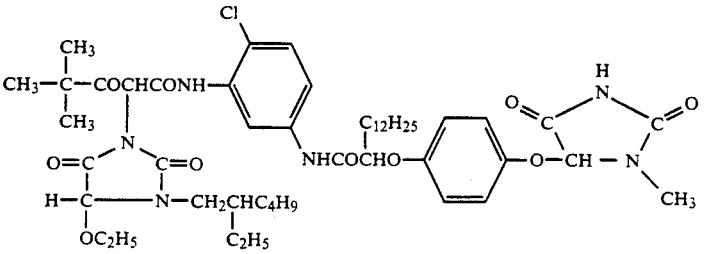

-continued
(Y-21)
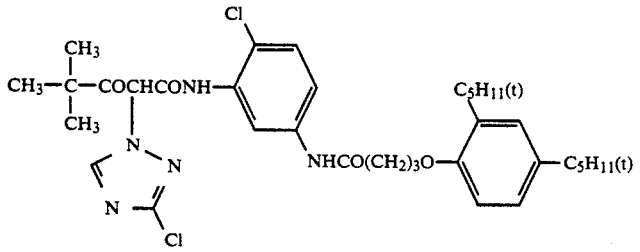
(Y-22)
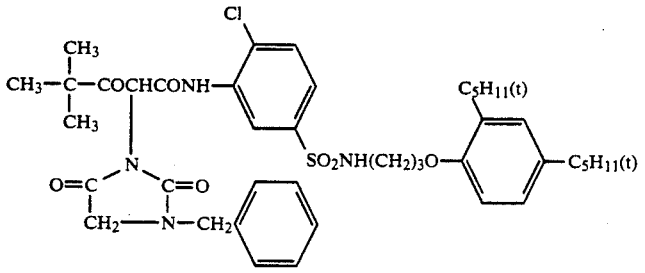
(Y-23)
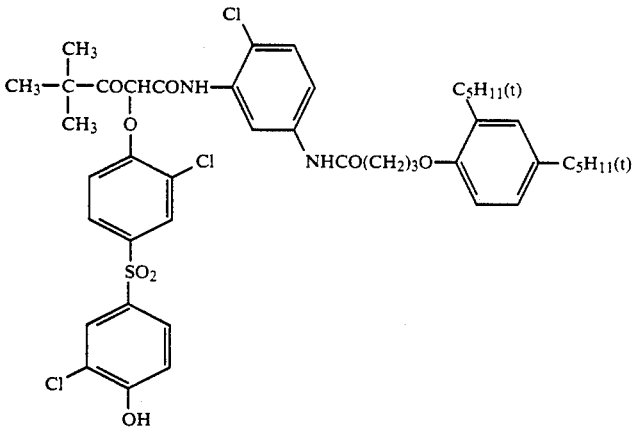
(Y-24)
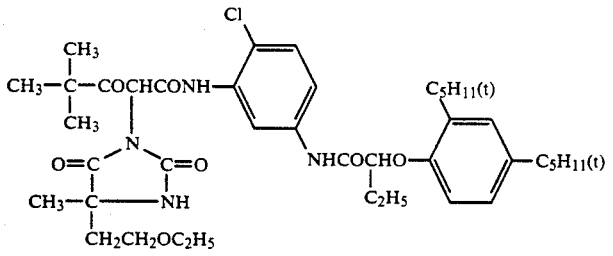
(Y-25)
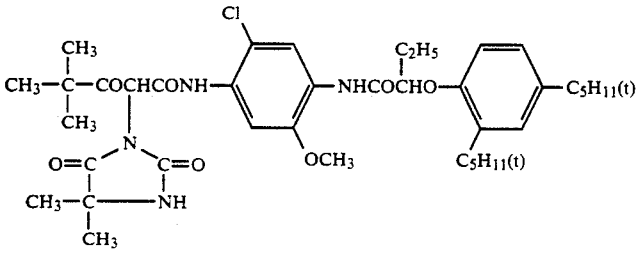

-continued
(Y-26)
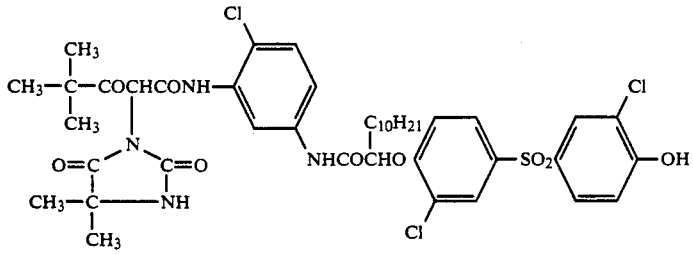
(Y-27)
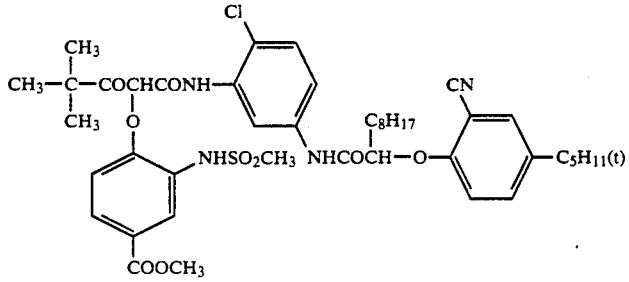
(Y-28)
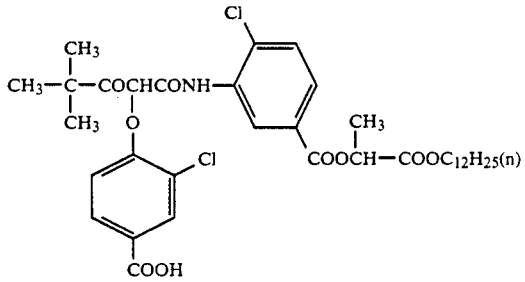
(Y-29)
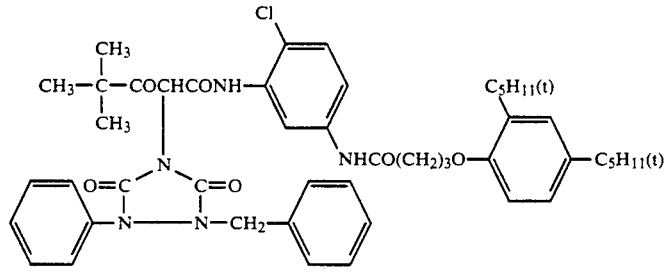
(Y-30)
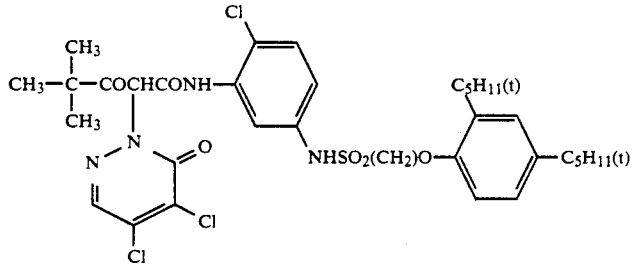
(Y-31)
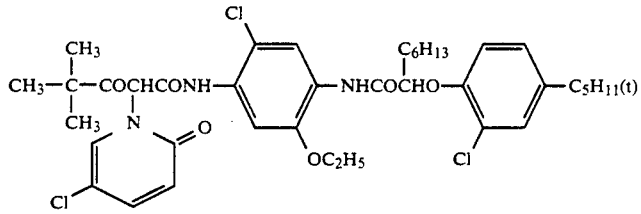

-continued
(Y-32)
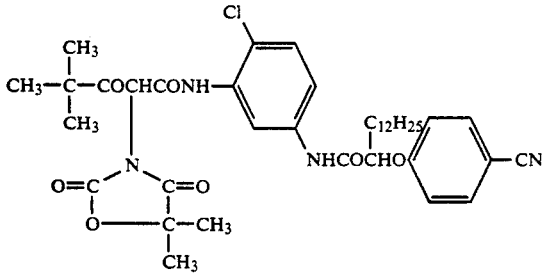
(Y-33)
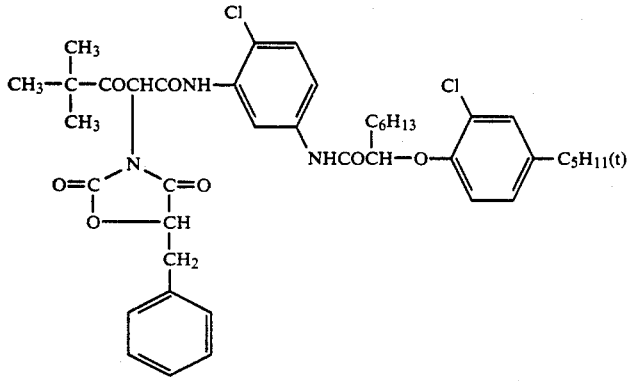
(Y-34)
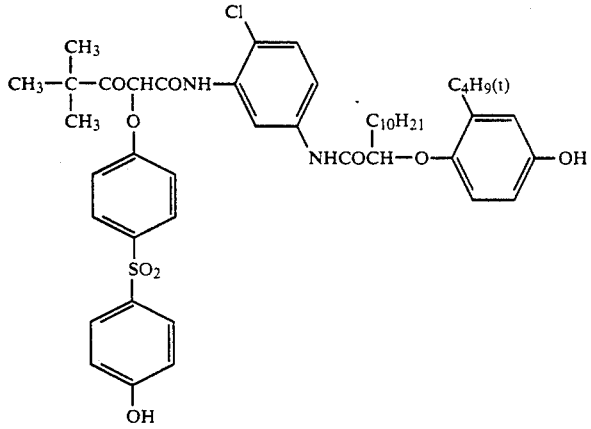
(Y-35)
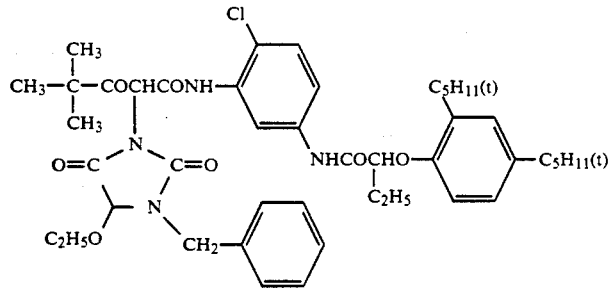
(Y-36)
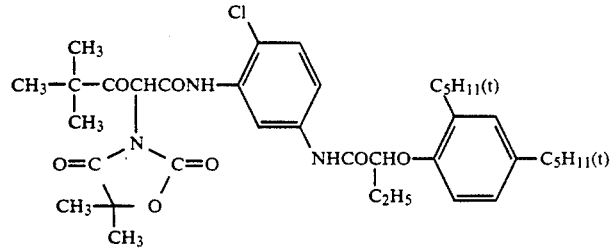

-continued
(Y-37)
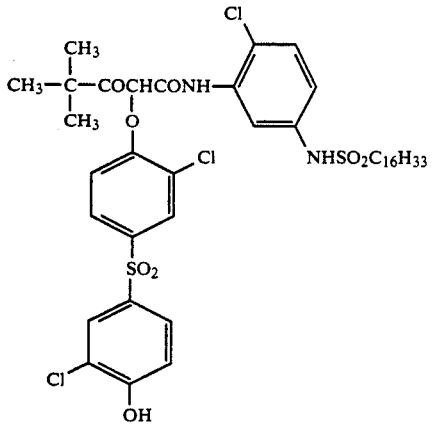
(Y-38)
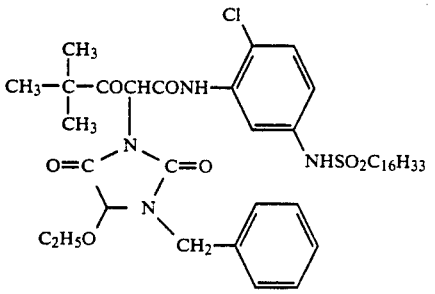
(Y-39)
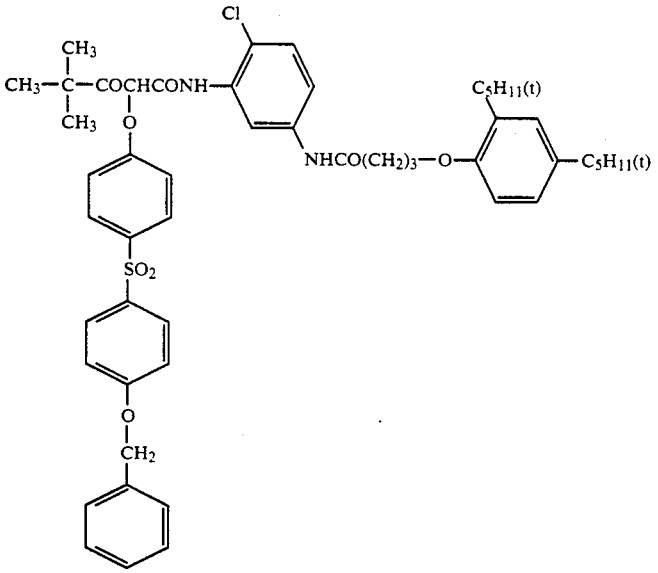
(Y-40)
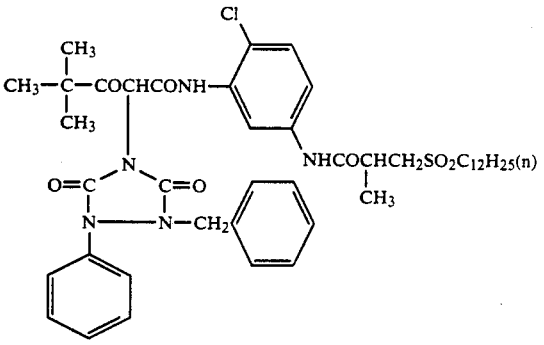
The amount of the epoxy compounds represented by formulae (I) to (III) to be added is generally 0.001 to 10

According to one embodiment in practicing the present invention, the photographic material of this invention is subjected to such a rapid color development processing as the color development processing time is 30 sec or less. In the embodiment it is preferable to use a silver halide emulsion comprising 90 mol % or more of silver chloride. Color development processing time is more preferably 25 sec or less, and particularly preferably 20 sec or less.

Total processing time including a rapid color development is preferably 180 sec or less, more preferably 120 sec or less, and particularly preferably 90 sec or less.

Further, the color photographic material of the present invention is preferably one that shows 3.0 mmol/$m^2$ or less of alkali consumption. The alkali consumption is an indication of the amount of acidic components contained in the photographic material, which amount influences a development speed.

The alkali consumption of photographic material is obtained by the following measuring method and calculation. As the first step for calculating an alkali consumption, a definite area (concretely, 1 square meter) of photographic material is sampled and is separated into a support and coating layers. As an ordinary support is formed by laminating polyethylene film on a paper, separation is effected between layers. Next, the coating layer part is divided finely and then is dispersed in a definite amount (concretely, 100 ml) of water. Then, the dispersion is titrated by an aqueous alkali solution (concretely, 0.1 N potassium hydroxide solution). The alkali consumption is defined as mmol of potassium hydroxide required to reach pH 10.0 from pH 6.0 in the above titration.

When a support contains acid components but cannot be separated as described above, the evaluation is done by subtracting the alkali consumption for support alone.

This alkali consumption is influenced by gelatin that is a hydrophilic binder in a photographic material and other organic compounds.

The alkali consumption is preferably 3.0 mmol/$m^2$ or less, more preferably 2.8 mmol/$m^2$ or less, further more preferably 2.6 mmol/$m^2$ and particularly preferably 1.9 mmol/$m^2$ or less.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion used in the present invention, one comprising silver chlorobromide or silver chloride of silver chloride content 90 mol % or over and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsion, the ratio of silver bromide/silver chloride can be selected arbitrarily. That is, the ratio is selected from the broad range in accordance with the purpose, but the ratio of silver chloride in a silver chlorobromide is preferably 2% or more.

Further in the photographic material suitable for a rapid processing an emulsion of high silver chloride content, a so-called high-silver-chloride emulsion may be used preferably. The content of silver chloride of the high-silver-chloride emulsion is preferably 90 mol % or more, more preferably 95 mol % or more.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

Preferably in the present invention a sparingly water-soluble epoxy compound represented by formula (I), (II), or (III) is incorporated in a silver halide photographic material that has at least one photosensitive layer containing silver halide emulsion grains which have been spectrally sensitized by a spectral sensitizing dye having a peak wavelength of spectral sensitivity at 730 nm. According to this embodiment a silver halide photographic material having little change of sensitivity after storage thereof, suitable for infrared exposure and capable of being rapidly processed can be obtained.

In he silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-latent image-type emulsion, wherein a latent image is formed mainly on the grain surface, or of a so-called internal latent image-type emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Magenta couplers preferably used in the present invention are those represented by the following formulae (M-I) and (M-II):

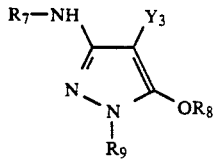

Formula (M-I)

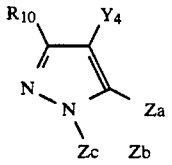

Formula (M-II)

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976,pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

Specific examples of couplers represented by formulae (M-I) and (M-II) are listed below.

(M-1)

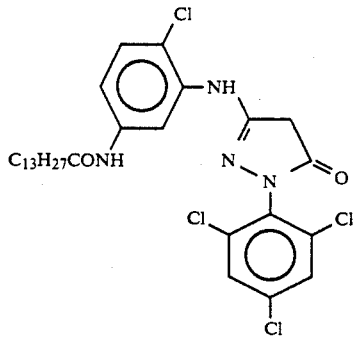

(M-2)

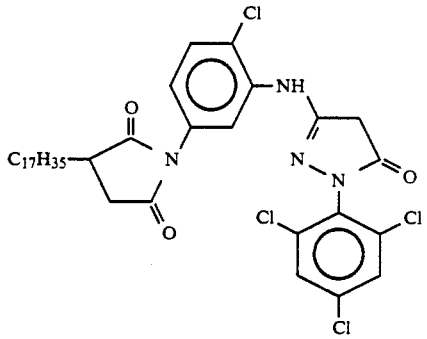

(M-3)

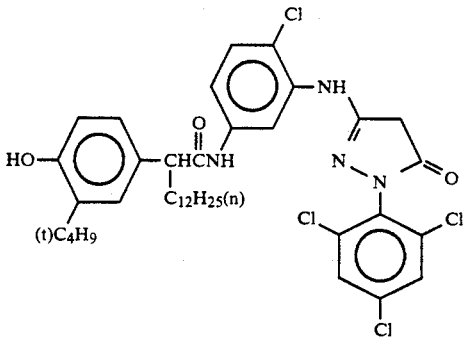

(M-4)

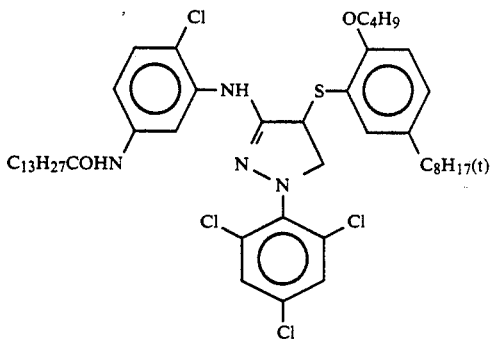

-continued
(M-5)
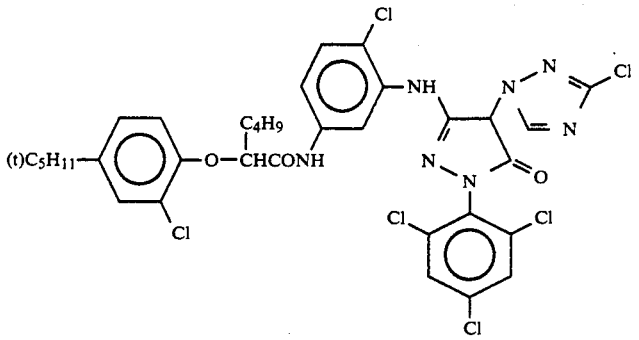
(M-6)
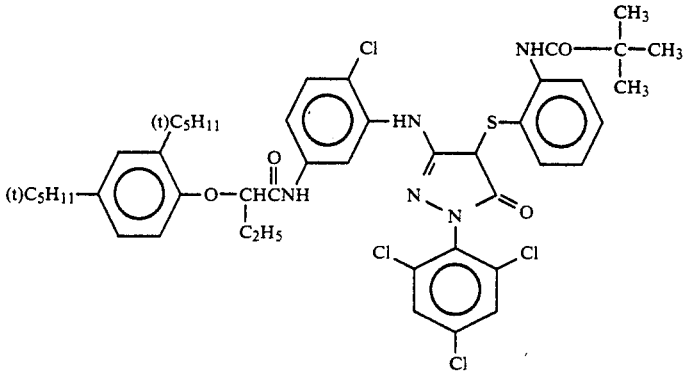
(M-7)
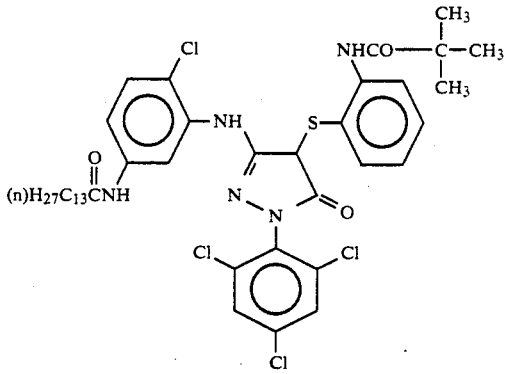
(M-8)
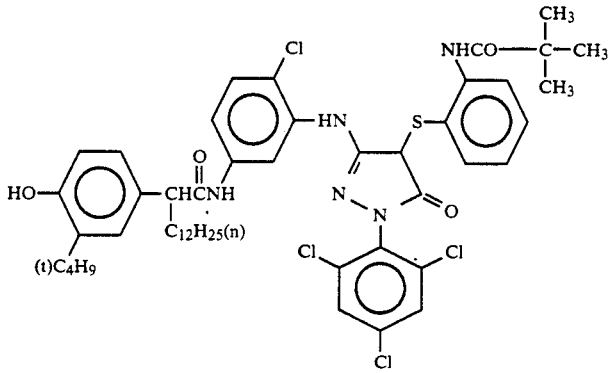

| Compound | $R_{10}$ | $R_{15}$ | $Y_4$ |
|---|---|---|---|
| | | 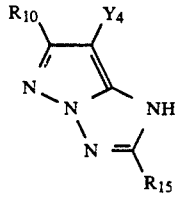 | |
| M-9 | $CH_3$— | 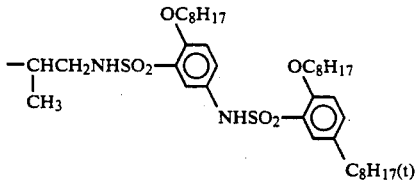 | Cl |
| M-10 | The same as the above | 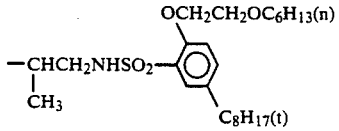 | The same as the above |
| M-11 | $(CH_3)_3C$— | 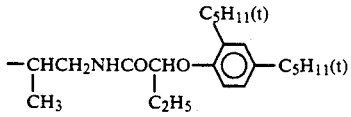 | 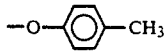 |
| M-12 | 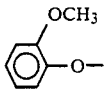 | 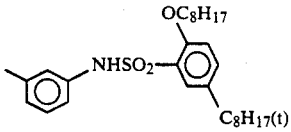 | 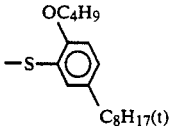 |
| M-13 | $CH_3$— | 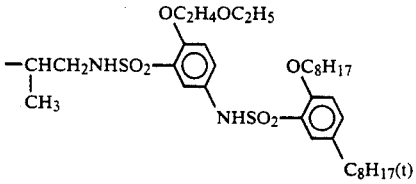 | Cl |
| M-14 | The same as the above | 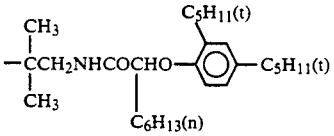 | The same as the above |
| M-15 | The same as the above | 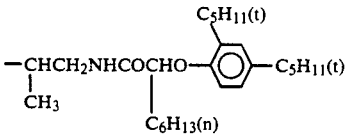 | The same as the above |
| M-16 | The same as the above | 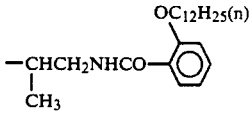 | The same as the above |
| M-17 | The same as the above | 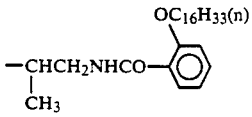 | The same as the above |

-continued
| Compound | $R_{10}$ | $R_{15}$ | $Y_4$ |
|---|---|---|---|
| M-18 | 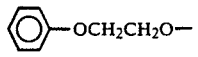 | 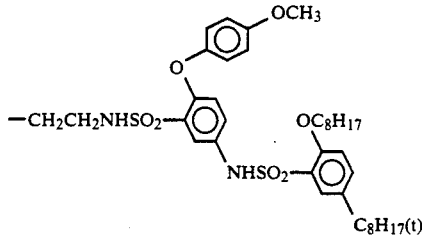 | 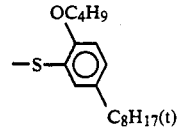 |
| M-19 | $CH_3CH_2O-$ | The same as the above | The same as the above |
| M-20 | 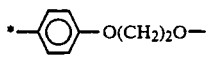 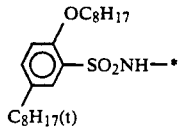 | 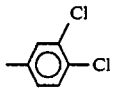 | 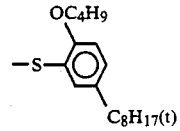 |
| M-21 | 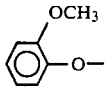 | 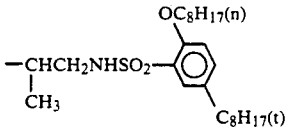 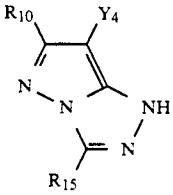 | Cl |
| M-22 | $CH_3-$ | 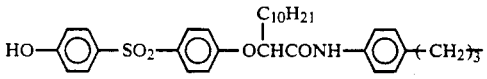 | Cl |
| M-23 | The same as the above | 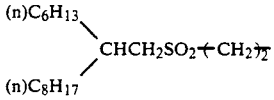 | The same as the above |
| M-24 | 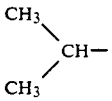 | 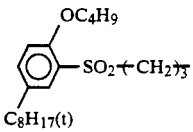 | The same as the above |
| M-25 | 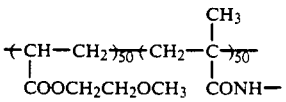 | 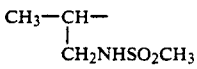 | The same as the above |
| M-26 | 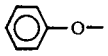 | 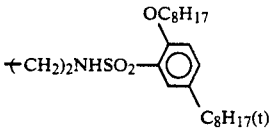 | The same as the above |
| M-27 | $CH_3-$ | 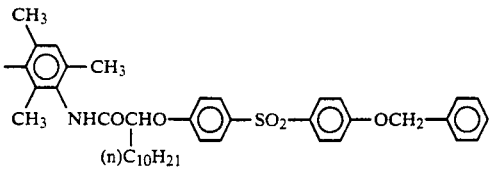 | Cl |

-continued

| Compound | $R_{10}$ | $R_{15}$ | $Y_4$ |
|---|---|---|---|
| M-28 | $(CH_3)_3C-$ | 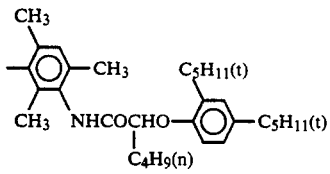 | The same as the above |
| M-29 | 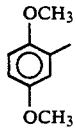 | 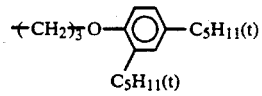 | The same as the above |
| M-30 | $CH_3-$ | $-CH(n)C_{18}H_{37}-NCOCH_2CH_2COOH$ ($C_2H_5$) | The same as the above |

The couplers represented by formulae (M-I) and (M-II) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As high-boiling organic solvents, high-boiling organic solvents represented by the following formulae (A) to (E) are preferably used,

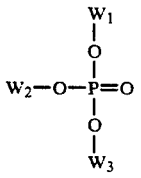
(Formula (A))

$W_1-COO-W_2$ Formula (B)

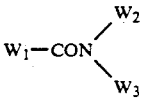
Formula (C)

-continued

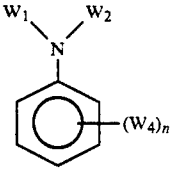
Formula (D)

$W_1-O-W_2$ Formula (E)

wherein $W_1$, $W_2$, and $W_3$ each represent a substituted or unsubstituted, alkyl group, cycloalkyl group, alkenyl group, aryl group, or heterocyclic group, $W_4$ represents $W_1$, $O-W_1$ or $S-W_1$, n is an integer of 1 to 5, when n is 2 or over, $W_4$ groups may be the same or different, and in formula (E), $W_1$ and $W_2$ may together form a condensed ring.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, another hydroquinone derivative, an aminophenol derivative, a gallic acid derivative, or an ascorbic acid derivative.

In the photographic material of the present invention, various anti-fading agents (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,307) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine having the second-order reaction-specific rate $k_2$ (in trioctyl phosphate at 80° C.) in the range of 1.0 1/mol·sec to $1\times10^{-5}$ 1/mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{11}-(A_1)_n-X_1 \qquad \text{Formula (FI)}$$

$$R_{12}-\underset{\underset{B_1}{|}}{C}=Y_1 \qquad \text{Formula (FII)}$$

wherein $R_{11}$ and $R_{12}$ each represent an aliphatic group, an aromatic group, or a heterocyclic group, n is 1 or 0, $A_1$ represents a group that will react with an aromatic amine developing agent to form a chemical bond therewith, $X_1$ represents a group that will react with the aromatic amine developing agent and split off, $B_1$ represents a hydrogen atom, an aliphatic group, an aromatic group, a heterocyclic group, an ayl group, or a sulfonyl group, $Y_1$ represents a group that will facilitate the addition of the aromatic amine developing agent to the compound represented by formula (FII), and $R_{11}$ and $X_1$, or $Y_1$ and $R_{12}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 283338/1987, European Published Patent Nos. 298,321 and 277,589.

On the other hand, more preferable examples of compound (G), which will chemically bond to the oxidized product of the aromatic amine developing agent remaining after color development processing, to form a chemically inactive and colorless compound, can be represented by the following formula (GI): Formula (GI)

$R_{13}$—Z wherein $R_{13}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein $^{n}CH_3I$ value (R. G. Pearson, et al., *J. Am. Cem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application Nos. 136724/1988 and 214681/1987, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purpose. Such dyes include oxonol dyes, hemioxonol dyes, styryl dyes, merocyanine dyes, cyanine dyes, and azo dyes. Among them, oxonol dyes, hemioxonol dyes, and merocyanine dyes are useful.

In the photographic material according to the present invention, for the purpose to improve the sharpness of image or the like, it is preferable to add a dye capable of decolorization by processing, as described in European Patent No. 0,337,490A2, pp. 27–76 (among them, oxonol-type dyes are preferable) into the hydrophilic colloid layer in such amount that the optical reflection density at 680 nm of said photographic material would be 0.70 or over, and/or to add titanium oxide particles that has been surface-treated by divalent to tetravalent alcohol (e.g., trimethylolethane) in an amount of 12 wt. % or more (more preferably, 14 wt. % or more) into the water-resistant resin layer of the base.

As a binder or a protective colloid that can be used in the emulsion layers of photographic materials of the present invention, gelatin is advantageously used, but other hydrophilic colloids can be used alone or in combination with gelatin.

In the present invention, gelatin may be lime-treated gelatin or acid-processed gelatin. Details of the manufacture of gelatin is described by Arther Veis in *The Macromolecular Chemistry of Gelatin* (published by Academic Press,1964). In the photographic material of the present invention, it is preferable to add a mold-proofing agent as described in, for example, JP-A No. 271247/1988, in order to prevent occurrence of molds and fungi that would propagate in the hydrophilic colloid layer and deteriorate images.

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamido film, polycarbonate film, polystyrene film, and vinyl chloride resins.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface mat be a metal plate, metal foil or metal thin layer obtained by rolling, vapor deposition or galvanizing of metal, such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base described, for example, in JP-A Nos. 210346/1986, 24247/1988, 24251/1988, and 24255/1988.

Further, as a base for use in the photographic material of the present invention, a white polyester film base or a base that is provided a layer containing a white pigment on the base of the silver halide emulsion layer side may be used for display purpose. Further, it is preferable to apply an antihalation layer on the silver halide emulsion layer side or on back side. In particular, it is preferable to set the transmission density of base in a range of 0.35 to 0.8 so as to be able to view a display both under reflected light and transmitted light.

These bases can be suitably selected according to the purpose for use.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigmented finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or more. Therefore, the deviation coefficient $s/\overline{R}$ can be obtained by $$\sqrt{\frac{\sum_{i=1}^{n}(R_i-\overline{R})^2}{n-1}} \Big/ \frac{\sum_{i=1}^{n}R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform".

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air. The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05 $cm^{-1}$.

Methods for reducing the opened surface ratio that can be mentioned include the utilization of movable lids as described in JP-A NO. 241342/1987 and a slit-developing process as described in JP-A No. 216050/1988, besides a method of providing shutting materials such as floating lids.

It is preferable to adopt the means for reducing the opened surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having a high concentration of color developing agent.

The photographic emulsion layers are generally subjected to a bleaching process after color development.

The bleaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, but if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 3,893,858 West German Patent No. 1,290,812, JP-A No. 95630/1978, and Research Disclosure No. 17129 (July, 1978); thiazolidine derivatives, described in JP-A No. 140129/1975; thiourea derivatives, described in U.A. Patent No. 3,706,561; iodide salts, described in JP-A No. 16235/1983; polyoxyethylene compounds in West German Patent No. 2,748,430; polyamine compounds, described in JP-B No. 8836/1970; and bromide ions. Of these, compounds having a mercapto group or a disulfide group are preferable in view of higher acceleration effect, and in particular, compounds described in U.A. Patent No. 3,893,858, West German Patent No. 1,290,812, and JP-A No. 5630/1978 are preferable. Compound described in U.S. Pat. No. 4,552,834 are preferable. These bleach-accelerating agents may be added into a photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers,* Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kagaku,* (1986) published by Sankyo-Shuppan, *Biseibutsu no Mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for 20 sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flowed solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C.. Although generally a temperature of 33° to 38° C. may be standard, a higher temperature can be used to accelerate the process to reduce the processing time, or a lower temperature can be used to improve the image quality or the stability of the processing solution. Also, to save the silver of the photographic material, a process using hydrogen peroxide intensification or cobalt intensification described in West German Patent No. 2,226,770 and U.S. Pat. No. 3,674,499 may be carried out.

The silver halide color photographic material of the present invention forms a dye image excellent in preservability of color image that is restrained light-fading, dark-fading, fading in high humidity and fading due to acid.

Next, the present invention will be described in detail in accordance with examples, but the invention is not limited to these examples.

EXAMPLE 1

A multilayer color photographic paper A (for comparison) was prepared by multi-coatings composed of the following layer composition on a two-side polyethylene laminated paper support. Coating solutions were prepared as follows:

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.70 μm of average grain size, and 0.08 and 0.10 of deviation coefficient of grain size distribution, respectively, each in which 0.2 mol% of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first layer coating solution. As a gelatin hardener for the respective layers, 1-oxy-3,5-dichloro-s-treazine sodium salt was used. Further, in all coating solutions from the first to the seventh layer, compounds shown below were added for preventing occurrence of putrefaction and mold.

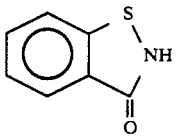

(25 mg/m²)

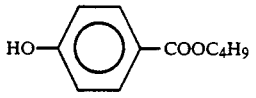

(25 mg/m²)

-continued

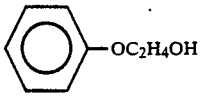

(500 mg/m²)

As spectral-sensitizing dyes for the respective layers, the following compounds were used:

Blue-sensitive emulsion layer:

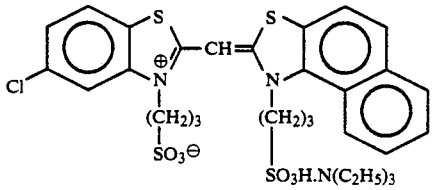

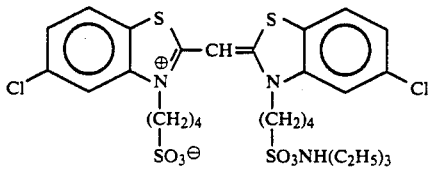

(each $2.0\times10^{-4}$ mol to the large size emulsion and $2.5\times10^{-4}$ mol to the small size emulsion, per mol of silver halide.)

Green-sensitive emulsion layer:

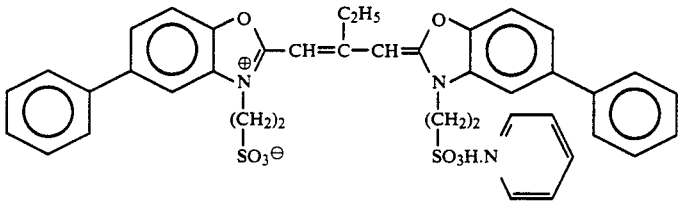

($4.0\times10^{-4}$ mol to the large size emulsion and $5.6\times10^{-4}$ mol to the small size emulsion, per mol of silver halide) and

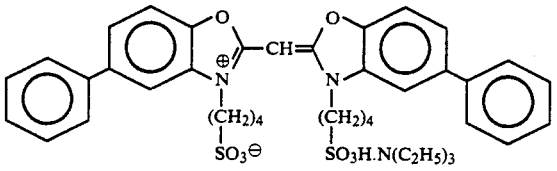

($7.0\times10^{-5}$ mol to the large size emulsion and $1.0\times10^{-5}$ mol to the small size emulsion, per mol of silver halide)

Red-sensitive emulsion layer:

-continued

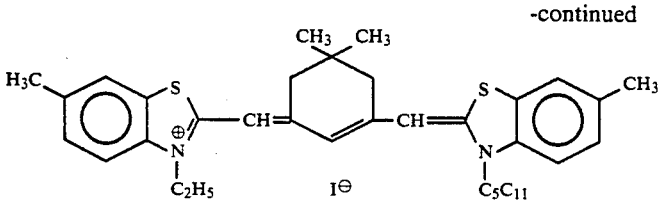

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

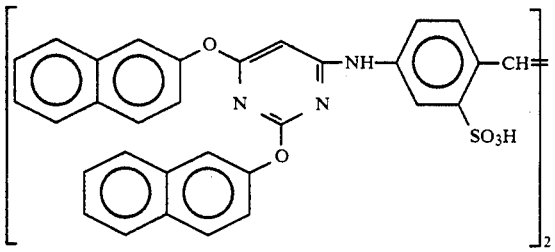

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive layer in an amount of $1\times10^{-4}$ and $2\times10^{-4}$, per mol of silver halide, respectively.

The dyes shown below were added to the emulsion layers for prevention of irradiation.

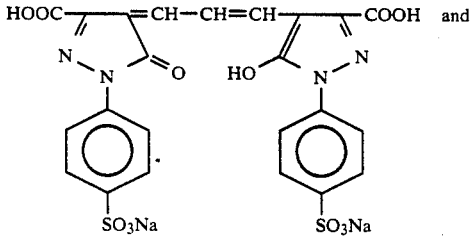

and

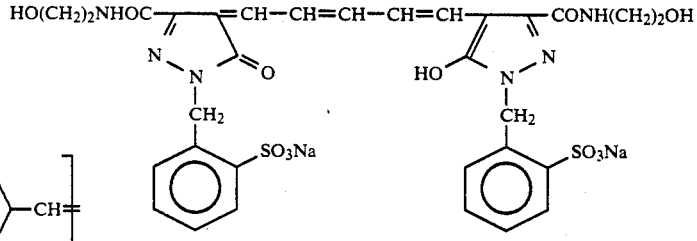

Composition of Layers

The composition of each layer is shown below. The figures represent coating amount (g/m²). The coating amount of each silver halide emulsion is given in terms of silver.

| | |
|---|---|
| Supporting Base | |
| Paper laminated on both sides with polyethylene (a white pigment, $TiO_2$, and a bluish dye, ultramarine, were included in the first layer side of the polyethylene-laminated film) | |
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |

-continued

| | |
|---|---|
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet abosrbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.30 |
| Image-dye stabilizer (Cpd-8) | 0.04 |
| Solvent (Solv-6) | 0.30 |
| Sixth Layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R = 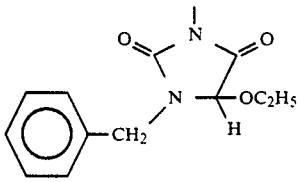 and R = 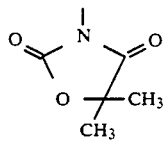

of the following formula

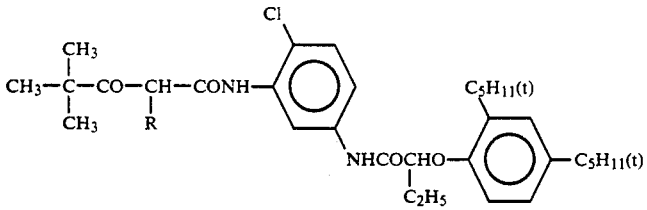

(ExM) Magenta coupler

Mixture (1:1 in molar ratio) of

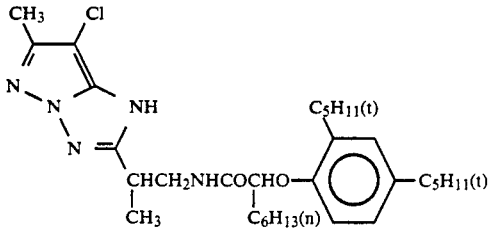

and

-continued
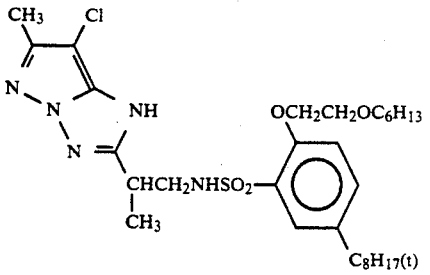
(ExC) Cyan coupler
Mixture ((a):(b):(c) = 2:4:4 in weight ratio) of (a) R = $C_2H_5$ and (b) R = $C_4H_9$ of
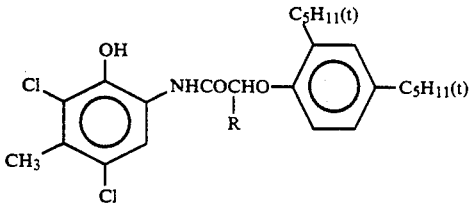
and
0
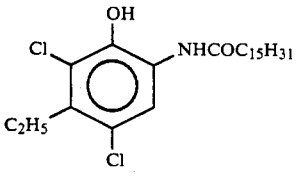
(Cpd-1) Image-dye stabilizer
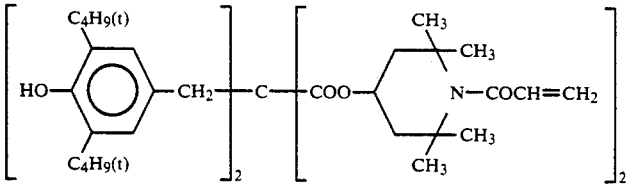
(Cpd-2) Image-dye stabilizer
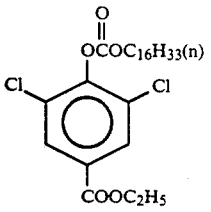
(Cpd-3) Image-dye stabilizer
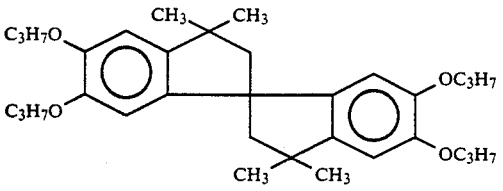
(Cpd-4) Image-dye stabilizer -continued
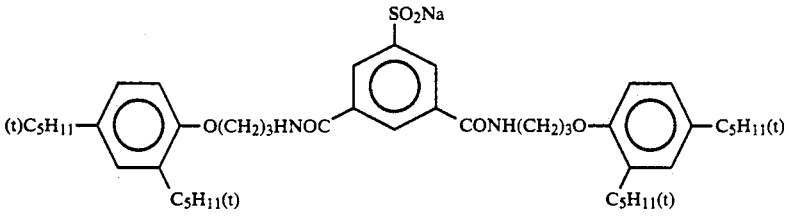
(Cpd-25 Image-dye stabilizer
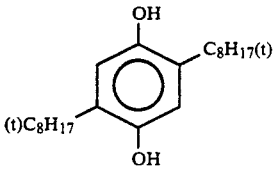
(Cpd-6) Image-dye stabilizer
Mixture (2:4:4 in weight ratio) of
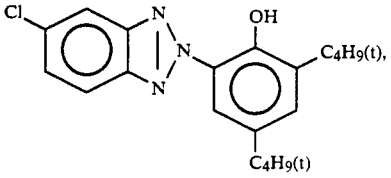
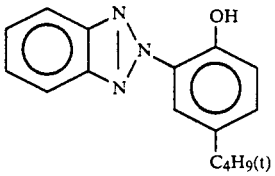
and
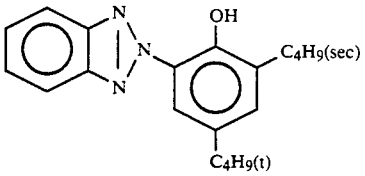
(Cpd-7) Image-dye stabilizer
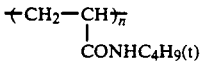
Average molecular weight: 60,000
(Cpd-8) Image-dye stabilizer
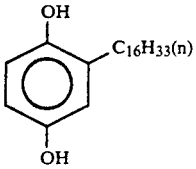
(Cpd-9) Image-dye stabilizer -continued
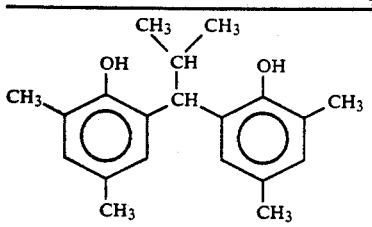
(UV-1) Ultraviolet ray absorber
Mixture (4:2:4 in weight ratio) of
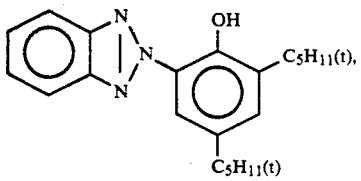
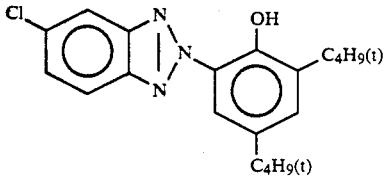
and
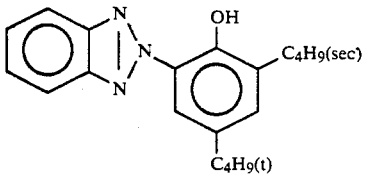
(Solv-1) Solvent
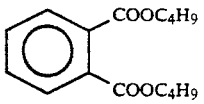
(Solv-2) Solvent
Mixture (2:1 in volume ratio) of
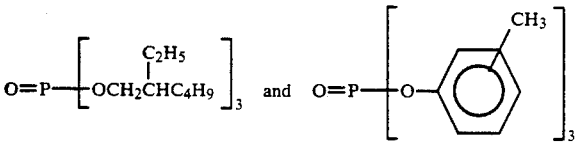
(Solv-4) Solvent
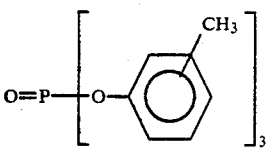
(Solv-5) Solvent
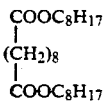

-continued (Solv-6) Solvent

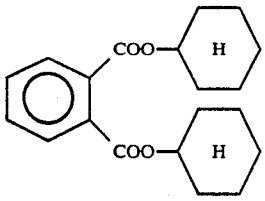

(Solv-7) Solvent

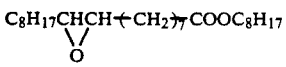

(Solv-8) Solvent

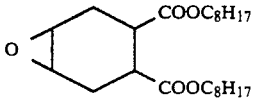

(Solv-9) Solvent

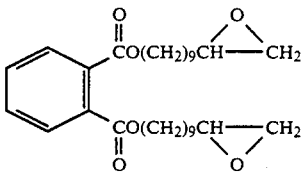

Color photographic papers according to the present invention were prepared in the same composition as Sample A, except that various epoxy compounds in a prescribed amount were used instead of solvent (Solv-6) used in the fifth layer (red-sensitive emulsion layer) of Sample A, as shown in Table 1.

TABLE 1

| Color Photographic Paper | | Epoxy Compound | Replacemet Ratio of Solv-6 |
|---|---|---|---|
| A | (for Comparison) | — | — |
| B | " | Solv-7 | 100 |
| C | " | Solv-8 | 100 |
| D | (This Invention) | I-2 | 50 |
| E | " | I-2 | 100 |
| F | " | I-4 | 50 |
| G | " | I-4 | 100 |
| H | " | I-5 | 50 |
| I | " | I-8 | 100 |
| J | " | II-1 | 100 |
| K | " | II-2 | 100 |
| L | " | III-1 | 100 |
| M | " | III-2 | 100 |
| N | (for Comparison) | Solv-9 | 100 |

First, each of samples was subjected to a gradation exposure to three separated colors for sensitometry using a sensitometer (FMH Model manufactured by Fuji Photo Film Co., Ltd., the color temperature of light source was 3,200°K.). At that time, the exposure to light was carried out in such a manner that the exposure was 250 CMS with the exposure time being 0.1 sec.

After exposure to light, each sample was subjected to a continuous processing (running test) by the processing procedure shown below using a paper-processor, until a volume of color developer twice that of a tank had been replenished.

| Processing step | Temperature | Time | Replenisher* | Tank Volume |
|---|---|---|---|---|
| Color developing | 35° C. | 45 sec. | 161 ml | 17 liter |
| Bleach-fixing | 30–35° C. | 45 sec. | 215 ml | 17 liter |
| Rinse (1) | 30–35° C. | 20 sec. | — | 10 liter |
| Rinse (2) | 30–35° C. | 20 sec. | — | 10 liter |
| Rinse (3) | 30–35° C. | 20 sec. | 350 ml | 10 liter |
| Drying | 70–80° C. | 60 sec. | | |

Note:
*Replenisher amount: ml per $m^2$ of photographic material. (Rinse steps were carried out in three tanks counter-current flow system from the tank of rinse (3) towards the tank of rinse (1).)
The compositions of each processing solution were as follows:

| Color developer | Tank Solution | Replenisher |
|---|---|---|
| Water | 800 ml | 800 ml |
| Ethylenediamine-N,N,N,N-tetra-methylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfonate | 5.5 g | 7.0 g |
| N,N-Bis(carboxmethyl)hydrazine | 5.5 g | 7.0 g |
| Fluorescent brightening agent (WHITEX-4B, made by Sumitomo Chemical Ind. Co.) | 1.0 g | 2.0 g |
| Water to make | 1000 ml | 1000 ml |
| pH (25° C.) | 10.05 | 10.45 |
| Bleach-fixing solution (Both tank solution and replenisher) | | |
| Water | 400 ml | |
| Ammonium thiosulfate (70%) | 100 ml | |
| Sodium sulfite | 17 g | |
| Iron (III) ammonium ethylenediamine- | 55 g | |

-continued

| | |
|---|---|
| tetraacetate dihydrate | |
| Disodium ethylenediaminetetraacetate | 5 g |
| Ammonium bromide | 40 g |
| Water to make | 1000 ml |
| pH (25° C.) | 6.0 |
| Rinse solution | |
| (Both tank solution and replenisher) | |
| Ion-exchanged water (Calcium and magnesium each are contained in an amount of 3 ppm or below). | |

After processing, each photographic paper was immersed into 1 Normal solution of citric acid for one minute, followed by drying, and was kept three days at 80° C. Fastness of cyan dye image under acid condition was evaluated as a decrease of cyan density at initial density of 2.0.

At the same time, another above processed photographic paper was kept at 100° C. for 10 days. Fastness to heat of cyan dye image was evaluated as a decrease of cyan density at initial density of 2.0.

Further, the same processing as the above, except that the pH of bleach-fixing solution was adjusted to 4.8, was conducted. After measuring the reflection density at maximum cyan (Dmax), each photographic paper was immersed (reprocessed) in CN-16N2 (manufactured by Fuji Photo Film Co., Ltd.) to return a cyan leuco dye to color dye, and then reflection density was measured again. The degree of color restoration (leuco dye formation of cyan dye) was designated as color forming rate according to the following formula:

$$\text{Color forming rate (\%)} = \frac{\text{Cyan density before reprocessing}}{\text{Cyan density after reprocessing}} \times 100$$

Results are shown in Table 2.

TABLE 2

| Color Photographic Paper | Acid-Fastness 80° C., 3 days | Heat-Fastness 100° C. 10 days | Color Forming Rate (%) (Leuco dye formation) |
|---|---|---|---|
| A (for Comparison) | 0.77 | 0.86 | 84 |
| B " | 0.45 | 0.97 | 61 |
| C " | 0.39 | 0.90 | 62 |
| D (This Invention) | 0.16 | 0.68 | 87 |
| E " | 0.06 | 0.57 | 89 |
| F " | 0.20 | 0.61 | 85 |
| G " | 0.11 | 0.54 | 87 |
| H " | 0.24 | 0.59 | 84 |
| I " | 0.11 | 0.58 | 88 |
| J " | 0.09 | 0.52 | 87 |
| K " | 0.10 | 0.50 | 86 |
| L " | 0.30 | 0.48 | 88 |
| M " | 0.13 | 0.54 | 89 |
| N (for Comparison) | 0.42 | 0.92 | 67 |

As is apparent from the results in Table 2, it can be noticed that a color photographic paper using the epoxy compound according to this invention is excellent in fastness of cyan dye image under acid condition and to heat compared with conventional ones (samples A, B, C, and N) and the color forming rate (leuco dye formation) is not deteriorated as in photographic papers using epoxy compounds other than those defined in this invention.

EXAMPLE 2

Color photographic papers were prepared in the same manner as color photographic paper A in Example 1, except that as the solvent of first layer (blue-sensitive emulsion layer) epoxy compound of the present invention was added in addition to Solve-3, as shown in Table 3, respectively.

TABLE 3

| Color Photographic Paper | Epoxy Compound | Coating Amount ($g/m^2$) |
|---|---|---|
| O (This Invention) | I-2 | 0.09 |
| P " | I-2 | 0.18 |
| Q " | I-4 | 0.09 |
| R " | I-4 | 0.18 |
| S " | I-5 | 0.09 |
| T " | I-5 | 0.18 |
| U " | I-8 | 0.18 |
| V " | II-1 | 0.18 |
| W " | II-2 | 0.18 |
| X " | III-1 | 0.18 |
| Y " | III-2 | 0.18 |

Thus-prepared color photographic paper samples and Sample A (for comparison) were subjected to exposure to light and to processing in the same manner as in Example 1.

After processing, each photographic paper was immersed into 1 Normal solution of citric acid for one minute, followed by drying, and was kept three days at 80° C. or 40° C., 70% RH. Fastness of cyan dye image under acid condition was evaluated as a decrease of cyan density at initial density of 2.0.

At the same time, another above processed photographic paper was kept at 80° C., 70% RH for 2 weeks. Fastness to head and humidity of cyan dye image was evaluated as a decrease of cyan density at initial density of 2.0.

TABLE 4

| Color Photographic Paper | Acid Fastness* 80° C., 3 days | Acid Fastness* 40° C., 70% 3 days | Heat and Humidity Fastness*, 80° C., 70%, 3 weeks |
|---|---|---|---|
| A (for Comparison) | 0.31 | 0.46 | 0.21 |
| O (This Invention) | 0.12 | 0.13 | 0.15 |
| P " | 0.10 | 0.10 | 0.13 |
| Q " | 0.14 | 0.16 | 0.15 |
| R " | 0.11 | 0.13 | 0.13 |
| S " | 0.17 | 0.19 | 0.17 |
| T " | 0.13 | 0.14 | 0.14 |
| U " | 0.10 | 0.11 | 0.13 |
| V " | 0.09 | 0.10 | 0.14 |
| W " | 0.09 | 0.11 | 0.14 |
| X " | 0.12 | 0.15 | 0.16 |
| Y " | 0.13 | 0.17 | 0.15 |

Note:
*Decrement of density from initial density 2.0

As is apparent from the results in table 4, the yellow dye image of color photographic paper used epoxy compound in accordance with the present invention is superior in fastness and heat and humidity fastness compared with Sample A (comparison).

EXAMPLE 3

A multilayer color photographic paper A (for comparison) was prepared by multi-coatings composed of the following layer composition on a two-side polyethylene laminated paper support. Coating solutions were prepared as follows:

Preparation of the First Layer Coating Solution

To a mixture of 19.1 g of yellow coupler (ExY), 4.4 g of image-dye stabilizer (Cpd-1) and 1.8 g of image-dye stabilizer (Cpd-7), 27.2 ml of ethyl acetate and each 4.1 g of solvents (Solv-3) and (Solv-6) were added and dissolved. The resulting solution was dispersed and emulsified in 185 ml of 10% aqueous gelatin solution containing 8 ml of sodium dodecylbenzenesulfonate. Separately another emulsion was prepared by adding a blue-sensitive sensitizing dye, shown below, in an amount of $5.0\times10^{-4}$ per mol of silver to sulfur-sensitized silver chlorobromide emulsions (cubic grains, 1:3 (silver mol ratio) blend of grains having 0.85 μm of average grain size and 0.08 of deviation coefficient of grain size distribution and grains having 0.62 μm of average grain size and 0.07 of deviation coefficient of grain size distribution). The thus-prepared emulsion and the above-obtained emulsified dispersion were mixed together and dissolved to give the composition shown below, thereby preparing the first layer coating solution.

Coating solutions for the second to seventh layers were also prepared in the same manner as the first layer coating solution. As a gelatin hardener for the respective layers, 1-oxy-3,5-dichloro-s-treazine sodium salt was used.

As spectral-sensitizing dyes for the respective layers, the following compounds were used:

Blue-sensitive emulsion layer:

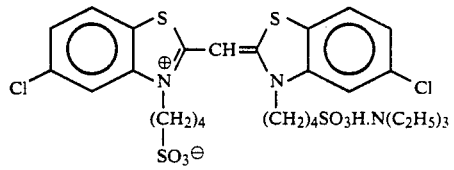

($5.0\times10^{-4}$ mol per mol of silver halide)

Green-sensitive emulsion layer:

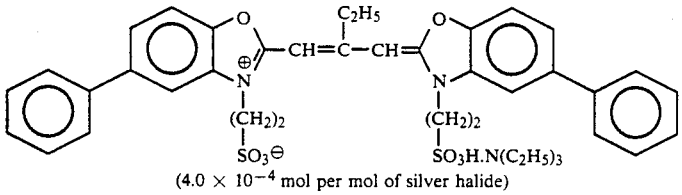

($4.0\times10^{-4}$ mol per mol of silver halide)

and

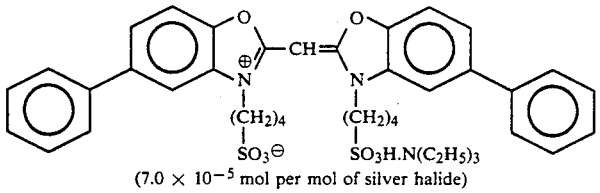

($7.0\times10^{-5}$ mol per mol of silver halide)

Red-sensitive emulsion layer:

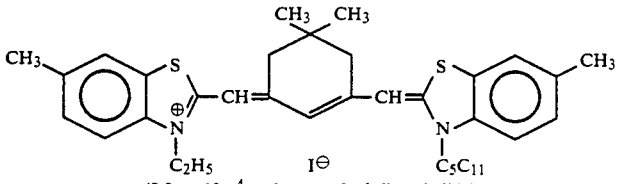

($0.9\times10^{-4}$ mol per mol of silver halide)

To the red-sensitive emulsion layer, the following compound was added in an amount of $2.6\times10^{-3}$ mol per mol of silver halide:

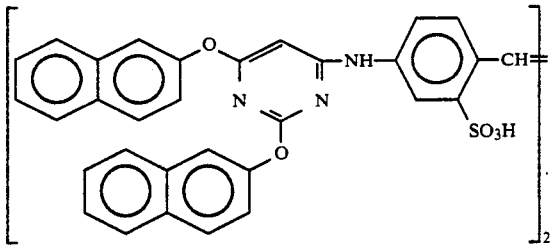

Further, to the blue-sensitive emulsion layer, the green-sensitive emulsion layer, and the red-sensitive emulsion layer, 1-(5-methylureidophenyl)-5-mercaptotetradole in amount of $4.0\times10^{-6}$ mol, $3.0\times10^{-5}$ mol, and $1.0\times10^{-5}$ mol, per mol of silver halide, respectively, and 2-methyl-5-t-octylhydroquinone in amount of $8\times10^{-3}$ mol, $2\times10^{-2}$ mol, and $2\times10^{-2}$ mol, per mol of silver halide, respectively, were added.

Further, 4-hydroxy-6-methyl-1,3,3a,7-tetrazaindene was added to the blue-sensitive emulsion layer and the green-sensitive layer in amount of $1.2\times10^{-2}$ and $1.1\times10^{-2}$, per mol of silver halide, respectively.

The dyes shown below were added to the emulsion layers for prevention of irradiation.

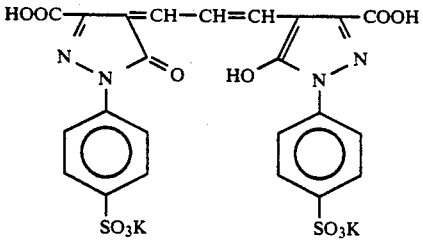

and

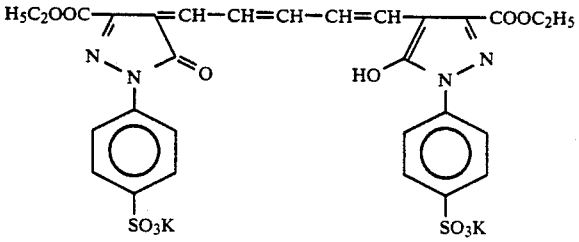

(Composition of Layers)

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

First Layer (Blue-sensitive emulsion layer)

| | |
|---|---|
| The above-described silver chlorobromide emulsion (AgBr: 80 mol %) | 0.26 |
| Gelatin | 1.83 |
| Yellow coupler (ExY) | 0.83 |
| Image-dye stabilizer (Cpd-1) | 0.19 |
| Image-dye stabilizer (Cpd-7) | 0.08 |
| Solvent (Solv-3) | 0.18 |
| Solvent (Solv-6) | 0.18 |

Second Layer (Color-mix preventing layer)

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |

Third Layer (Green-sensitive emulsion layer):

| | |
|---|---|
| Silver chlorobromide emulsions (1:1 in Ag mol ratio mixture of AgBr: 90 mol %, cubic grains having 0.47 μm of average grain size and 0.12 of deviation coefficient of grain size distribution and AgBr: 90 mol %, cubic grains having 0.36 μm of average grain size and 0.09 of deviation coefficient of grain size distribution) | 0.16 |
| Gelatin | 1.79 |
| Magenta coupler (ExM) | 0.32 |
| Image-dye stabilizer (Cpd-2) | 0.02 |
| Image-dye stabilizer (Cpd-3) | 0.20 |
| Image-dye stabilizer (Cpd-4) | 0.01 |
| Image-dye stabilizer (Cpd-8) | 0.03 |
| Image-dye stabilizer (Cpd-9) | 0.04 |
| Solvent (Solv-2) | 0.65 |

Fourth Layer (Ultraviolet absorbing layer)

| | |
|---|---|
| Gelatin | 1.58 |
| Ultraviolet absorver (UV-1) | 0.47 |
| Color-mix inhibitor (Cpd-5) | 0.05 |
| Solvent (Solv-5) | 0.24 |

Fifth Layer (Red-sensitive emulsion layer)

| | |
|---|---|
| Silver chlorobromide emulsions (1:2 in Ag mol ratio mixture of AgBr: 90 mol %, cubic grains having 0.47 μm of average grain size and 0.12 of deviation coefficient of grain size distribution and AgBr: 90 mol %, cubic grains having 0.36 μm of average grain size and 0.09 of deviation coefficient of grain size distribution) | 0.23 |
| Gelatin | 1.79 |
| Magenta coupler (ExM) | 0.32 |
| Image-dye stabilizer (Cpd-2) | 0.02 |
| Image-dye stabilizer (Cpd-3) | 0.20 |
| Image-dye stabilizer (Cpd-4) | 0.01 |
| Image-dye stabilizer (Cpd-8) | 0.03 |
| Image-dye stabilizer (Cpd-9) | 0.04 |

-continued

| | |
|---|---|
| Solvent (Solv-2) | 0.65 |
| Fourth Layer (Ultraviolet absorbing layer) | |
| Gelatin | 1.58 |
| Ultraviolet absorver (UV-1) | 0.47 |
| Color-mix inhibitor (Cpd-5) | 0.05 |
| Solvent (Solv-5) | 0.24 |
| Fifth Layer (Red-sensitive emulsion layer) | |
| Silver chlorobromide emulsions (1:2 in Ag mol ratio mixture of AgBr: 70 mol %, cubic grains having 0.49 μm of average grain size and 0.08 of deviation coefficient of grain size distribution and AgBr: 70 mol %, cubic grains having 0.34 μm of average grain size and 0.10 of deviation coefficient of grain size distribution) | 0.23 |
| Gelatin | 1.34 |
| Cyan coupler (ExC) | 0.30 |
| Image-dye stabilizer (Cpd-6) | 0.17 |
| Image-dye stabilizer (Cpd-7) | 0.40 |
| Solvent (Solv-6) | 0.20 |
| Sixth layer (Ultraviolet ray absorbing layer) | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(Cpd-1) Image-dye stabilizer

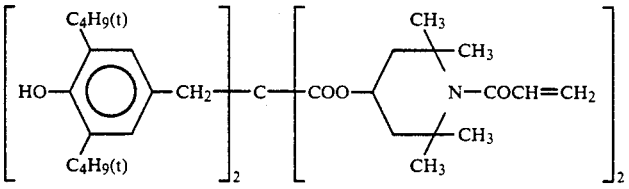

(Cpd-2) Image-dye stabilizer

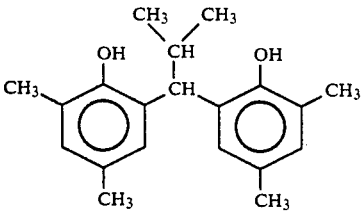

(Cpd-3) Image-dye stabilizer

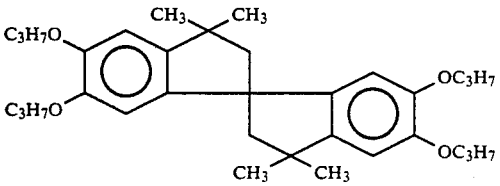

(Cpd-4) Image-dye stabilizer

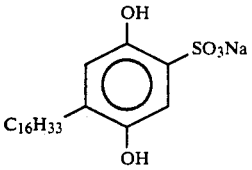

(Cpd-5) Image-dye stabilizer

-continued
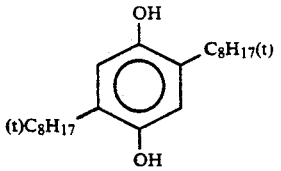
(Cpd-6) Image-dye stabilizer
Mixture (2:4:4 in weight ratio) of
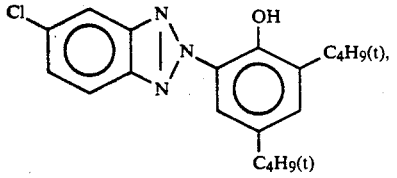
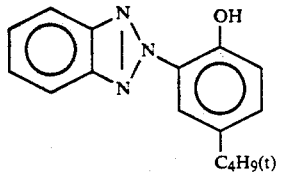
and
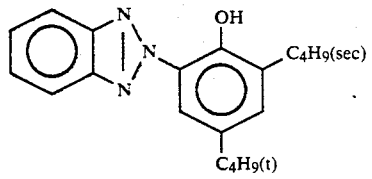
(Cpd-7) Image-dye stabilizer
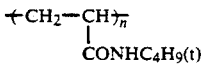
Average molecular weight: 80,000
(Cpd-8) Image-dye stabilizer
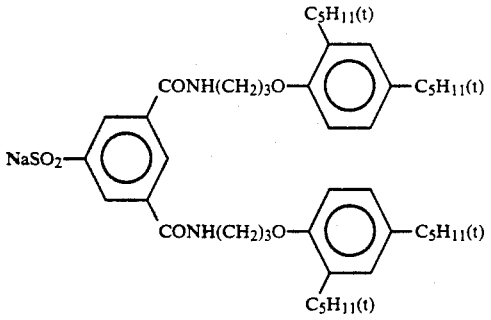
(Cpd-9) Image-dye stabilizer
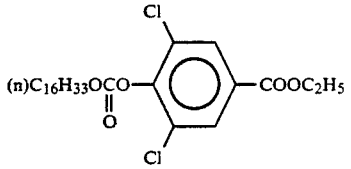
(UV-1) Ultraviolet ray absorber
Mixture (4:2:4 in weight ratio) of -continued
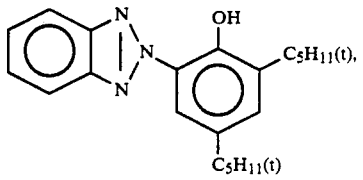
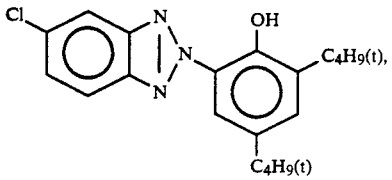
and
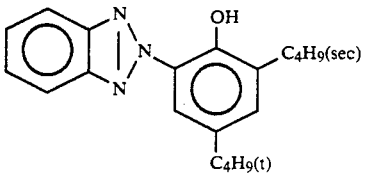
(Solv-1) Solvent
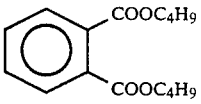
(Solv-2) Solvent
Mixture (2:1 in volume ratio) of
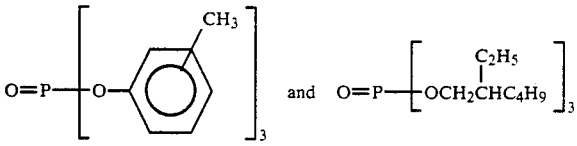
(Solv-3) Solvent
$O{=}P{-}[O{-}C_9H_{19}(iso)]_3$
(Solv-4) Solvent
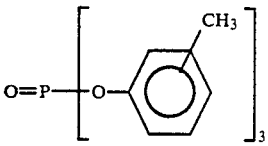
(Solv-5) Solvent
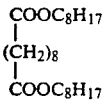
(Solv-6) Solvent -continued
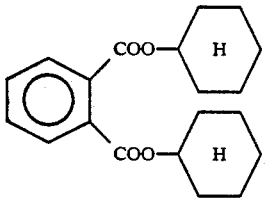
(Solv-7) Solvent
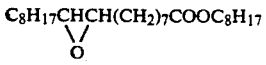
(Solv-8) Solvent
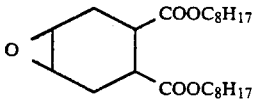
(ExY) Yellow coupler
Mixture (1:1 in molar ratio) of
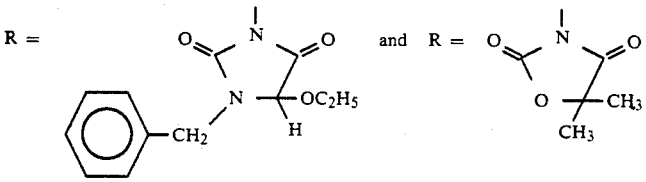
of the following formula
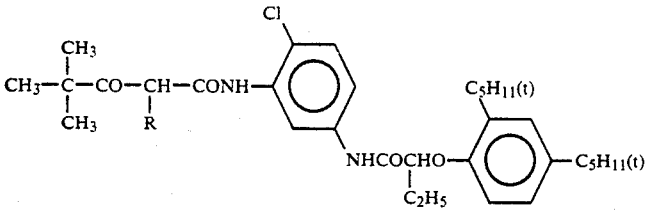
(ExM) Magenta coupler
Mixture (1:1 in molar ratio) of
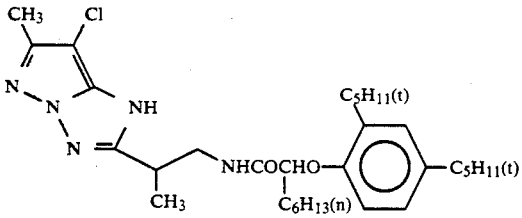
and
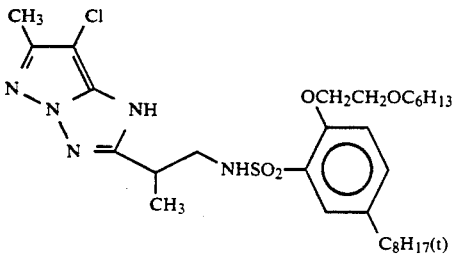
(ExC) Cyan coupler
Mixture (1:1 in molar ratio) of -continued

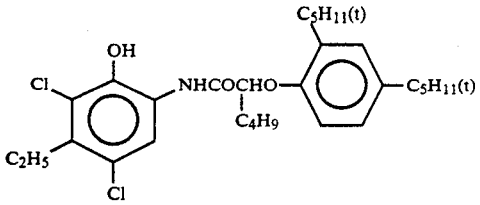

and

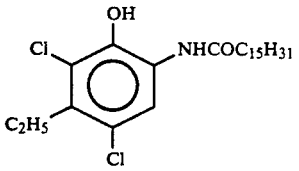

First, each of samples was subjected to a gradation exposure to three separated colors for sensitometry using a sensitometer (FMH Model manufactured by Fuji Photo Film Co., Ltd., the color temperature of light source was 3,200°K.). At that time, the exposure to light was carried out in such a manner that the exposure was 250 CMS with the exposure time being 0.1 sec.

After exposure to light, each sample was subjected to a processing according to the processing procedure and processing solution shown below using a paper-processor.

| Processing step | Temperature | Time |
|---|---|---|
| Color developing | 37° C. | 3 min 30 sec |
| Bleach-fixing | 33° C. | 1 min 30 sec |
| Water washing | 24–34° C. | 3 min |
| Drying | 70–80° C. | 1 min |

The compositions of each processing solution were as follows:

| Color developer | |
|---|---|
| Water | 800 ml |
| Diethylenetriamineheptaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfonate | 4.5 g |
| Hydroxylamine sufonate | 3.0 g |
| Fluorescent brightening agent (WHITEX-4B, made by Sumitomo Chemical Ind. Co.) | 1.0 g |
| Water to make | 1000 ml |
| pH (25° C.) | 10.25 |
| Bleach-fixing solution | |
| Water | 400 ml |
| Ammonium thiosulfate (70%) | 150 ml |
| Sodium sulfite | 18 g |
| Iron (III) ammonium ethylenediamine-tetraacetate dihydrate | 55 g |
| Disodium ethylenediaminetetraacetate | 5 g |
| Water to make | 1000 ml |
| pH (25° C.) | 6.70 |

Color photographic papers of the present invention were prepared in accordance with the above color photographic paper, and subjected to the same processing and test as in Examples 1 and 2. Results obtained were the same as in Examples 1 and 2, in that the color photographic paper of the present invention was excellent in fastness of storage in dark, fastness of storage under high humidity, and fastness to acid of cyan and yellow dye images.

EXAMPLE 4

Color photographic paper samples 401 to 428 were prepared in the same manner as color photographic paper A except that cyan coupler ExC of color photographic paper A was changed to same amount of cyan coupler shown in following Table 5, and Solv-6 was changed to same amount of comparative compound or epoxy compound was added as shown in Table 5. Irradiation preventing dyes were changed as shown below. After the same color-processing, each sample was subjected to image preserving tests (1) to (4).

Irradiation preventing dye

-continued

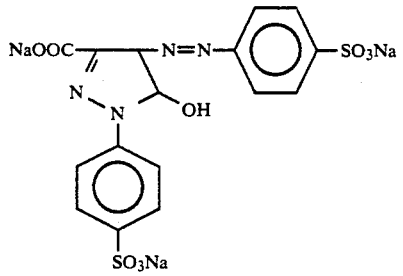

(10 mg/m²)

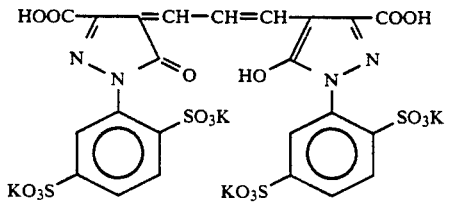

(10 mg/m²)

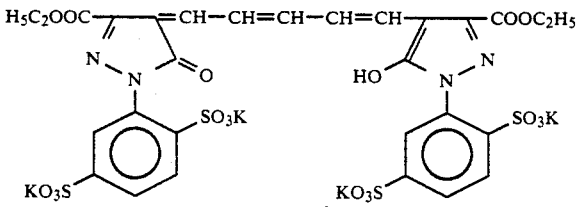

(40 mg/m²)

and

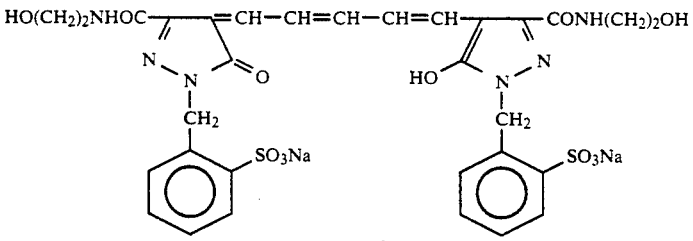

(20 mg/m²)

(1) Light-fading test

Exposure to light for 6 days using Xenon-tester (100,000 lux)

(2) Storage in dark test

Allowed to stand for 6 weeks in dark place kept at 60° C. and 70% RH.

(3) Fading by acid test

Immersing sample into 1N-citric acid solution followed by drying and then allowed to stand for 3 days at 80° C.

(4) Cyan stain test

Allowed to stand for 10 days at 80° C.

With respect to tests (1) to (3), decreasing ratio of density of cyan dye image at initial density of 2.0 was determined, and with respect to test (4), the increment of cyan colored density at white back-ground was determined. Results are shown in Table 5.

TABLE 5

| Sample No. | Remarks | Fifth Layer (Red-sensitive Emulsion Layer) Cyan Coupler | Solvent | Layer in which Epoxy Compound is added: Layer | Compound No. | Amount added (g/cm²) | Image Dye Stability Test: Light-Fading 10,000 lux 6 days (%) | Dark-Fading 60° C., 70% RH 6 weeks (%) | Acid-Fading in Citric Acid (%) | Cyan Stain 80° C., 10 days |
|---|---|---|---|---|---|---|---|---|---|---|
| 101 | Comparative Example | C-1 | Solv-6 | — | — | — | 18 | 20 | 39 | +0.03 |
| 102 | Comparative Example | " | Comparative compound (Solv-7) | — | — | — | 20 | 19 | 25 | +0.02 |

TABLE 5-continued

| Sample No. | Remarks | Fifth Layer (Red-sensitive Emulsion Layer) Cyan Coupler | Solvent | Layer in which Epoxy Compound is added Layer | Compound No. | Amount added (g/cm²) | Image Dye Stability Test Light-Fading 10,000 lux 6 days (%) | Dark-Fading 60° C., 70% RH 6 weeks (%) | Acid-Fading in Citric Acid (%) | Cyan Stain 80° C., 10 days |
|---|---|---|---|---|---|---|---|---|---|---|
| 103 | Comparative Example | IV-3 | Solv-6 | — | — | — | 9 | 7 | 69 | +0.11 |
| 104 | Comparative Example | " | Comparative compound (Solv-7) | — | — | — | 12 | 6 | 58 | +0.02 |
| 105 | Comparative Example | " | Comparative compound (Solv-9) | — | — | — | 11 | 6 | 54 | +0.02 |
| 106 | This Invention | " | Solv-6 | 4th layer (UV-absorbing layer) | I-2 | 0.15 | 9 | 5 | 5 | +0.01 |
| 107 | This Invention | " | " | 4th layer (UV-absorbing layer) | " | 0.05 | 9 | 5 | 6 | +0.01 |
| 108 | This Invention | IV-6 | " | 4th layer (UV-absorbing layer) | " | 0.10 | 8 | 5 | 4 | +0.01 |
| 109 | This Invention | IV-8 | " | 4th layer (UV-absorbing layer) | I-1 | 0.10 | 9 | 4 | 4 | +0.01 |
| 110 | This Invention | IV-17 | " | 4th layer (UV-absorbing layer) | II-2 | 0.08 | 8 | 3 | 4 | +0.02 |
| 111 | This Invention | IV-20 | Comparative compound (Solv-7) | 4th layer (UV-absorbing layer) | " | " | 9 | 4 | 3 | +0.01 |
| 112 | This Invention | IV-3 | Solv-6 | 6th layer (UV-absorbing layer) | II-1 | 0.10 | 8 | 4 | 4 | +0.01 |
| 113 | " | " | " | 6th layer (UV-absorbing layer) | I-9 | 0.15 | 8 | 4 | 4 | +0.01 |
| 114 | This Invention | " | " | 6th layer (UV-absorbing layer) | I-14 | 0.08 | 9 | 5 | 5 | +0.01 |
| 115 | This Invention | IV-6 | " | 6th layer (UV-absorbing layer) | III-2 | 0.05 | 8 | 4 | 4 | +0.01 |
| 116 | This Invention | IV-15 | " | 6th layer (UV-absorbing layer) | III-1 | 0.05 | 9 | 4 | 4 | +0.01 |
| 117 | This Invention | IV-8 | " | 6th layer (UV-absorbing layer) | I-8 | 0.05 | 9 | 4 | 4 | +0.01 |
| 118 | This Invention | IV-3 | " | 2nd layer (color-mix) inhibitor) | I-2 | 0.15 | 9 | 5 | 6 | +0.02 |
| 119 | This Invention | IV-6 | " | 2nd layer (color-mix inhibitor) | II-2 | 0.15 | 8 | 5 | 5 | +0.01 |
| 120 | This Invention | IV-3 | " | 2nd layer (color-mix inhibitor) | III-2 | 0.15 | 9 | 5 | 5 | +0.02 |
| 121 | This Invention | IV-8 | " | 2nd layer (color-mix inhibitor) | II-1 | 0.15 | 8 | 5 | 5 | +0.01 |
| 122 | This Invention | IV-3 | " | 4th and 6th layer | II-2<br>" | 0.10<br>0.05 | 9 | 4 | 2 | +0.01 |
| 123 | This Invention | " | " | 4th and 6th layer | II-2<br>" | 0.10<br>0.10 | 9 | 4 | 3 | +0.01 |

As is apparent from Table 5, in Samples 106 to 123 of the present invention, light-fastness, humidity and heat-fastness, and acid-fastness are improved and the increment of cyan density at white background after storage is restrained.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material which comprises in at least one photographic layer on a base at least one compound selected from the group consisting of sparingly water-soluble epoxy compounds represented by formula (I) given below and a dye-forming coupler:

Formula (I)

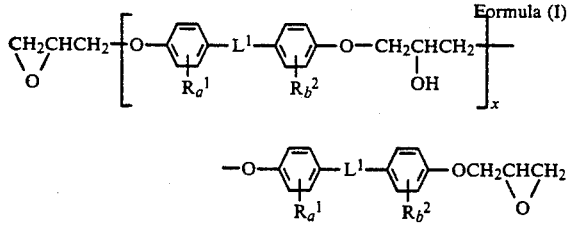

wherein $R^1$ and $R^2$ each represent an alkyl group or a halogen atom, each $L^1$ represents a divalent aliphatic organic group, a and b each are an integer of 0 to 4, and x is a real number of 0 to 20.

2. The silver halide color photographic material as claimed in claim 1, wherein the dye-forming coupler is a cyan coupler represented by the following formula (IV):

Formula (IV)

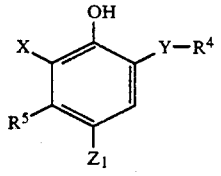

wherein Y represents —NHCO— or —CONH—, $R^4$ represents an aliphatic group, an aromatic group, a heterocyclic group, or an amino group, X represents a hydrogen atom, a halogen atom, an alkoxy group, or an acylamino group, $R^5$ represents an alkyl group or an acylamino group, or $R^5$ represents a group of nonmetallic atoms required to form a 5- to 7-membered ring by bonding with X, and $Z_1$ represents a hydrogen atom or a group capable of being released upon coupling reaction with the oxidized product of a color-developing agent.

3. The silver halide color photographic material as claimed in claim 1, wherein the dye-forming coupler is a cyan coupler represented by the following formula (IVa):

Formula (IVa)

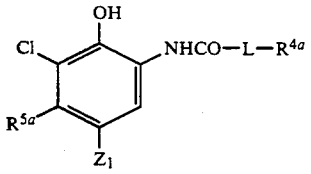

wherein $R^{4a}$ represents an alkyl group having at least 7 carbon atoms, $R^{5a}$ represents an alkyl group having 2 to 15 carbon atoms, L represents a mere bond or a divalent linking group, and $Z_1$ represents a hydrogen atom or a group capable of being released upon a coupling reaction with the oxidized product of a color-developing agent.

4. The silver halide color photographic material as claimed in claim 3, wherein $R^{4a}$ in formula (IVa) represents an octyl group, a tert-octyl group, a tridecyl group, a pentadecyl group, or a eicosyl group.

5. The silver halide color photographic material as claimed in claim 3, wherein L in formula (IVa) represents a divalent linking group is selected from the group consisting of an alkylene linkage, a phenylene linkage, an ether linkage, a carbonamido linkage, a sulfonamido linkage, an ester linkage, and a urethane linkage, and a divalent group formed by combining these groups.

6. The silver halide color photographic material as claimed in claim 3, wherein $R^{5a}$ in formula (IVa) represents an ethyl group, a butyl group, a tert-butyl group, a cyclohexyl group, or a pentadecyl group.

7. The silver halide color photographic material as claimed in claim 3, wherein $Z_1$ in formula (IVa) represents a hydrogen atom, a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group, or an aromatic azo group, which may contain a photographically useful group.

8. The silver halide color photographic material as claimed in claim 3, wherein $R^{4a}$ in formula (IVa) is an alkyl group having 10–22 carbon atoms.

9. The silver halide color photographic material as claimed in claim 3, wherein $R^{5a}$ in formula (IVa) is an alkyl group having 2–15 carbon atoms.

10. The silver halide color photographic material as claimed in claim 1, wherein the dye-forming coupler is a yellow coupler represented by the following formula (V):

Formula (V)

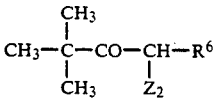

wherein $R^6$ represents an N-arylcarbamoyl group and $Z_2$ represents a group capable of being released upon coupling reaction with the oxidized product of an aromatic primary amine color-developing agent.

11. The silver halide color photographic material as claimed in claim 1, wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and nonphotosensitive hydrophilic colloid layers are provided on a base, and at least one of said silver halide emulsion layers contains at least one compound selected from the group consisting of sparingly water-soluble epoxy compounds represented by formula (I).

12. The silver halide color photographic material as claimed in claim 1, wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and nonphotosensitive hydrophilic colloid layers are provided on a base, and at least one of said nonphotosensitive hydrophilic colloid layers contains at least one compound selected from the group consisting of sparingly water-soluble epoxy compounds represented by formula (I).

13. The silver halide color photographic material as claimed in claim 6, wherein the cyan dye-forming coupler is a compound represented by formula (IVa):

Formula (IVa)

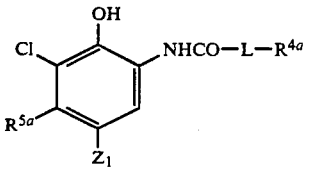

wherein $R^{4a}$ represents an alkyl group having at least 7 carbon atoms, $R^{5a}$ represents an alkyl group having 2 to 15 carbon atoms, L represents a mere bond or a divalent linking group, and $Z_1$ has the same meaning as defined in formula (IV).

14. The silver halide color photographic material as claimed in claim 1, wherein the solubility in water at 25° C. of the epoxy compound represented by formula (I) is 10% or below.

15. The silver halide color photographic material as claimed in claim 1, wherein each $L^1$ in the epoxy compound represented by formula (I) is selected from the group consisting of

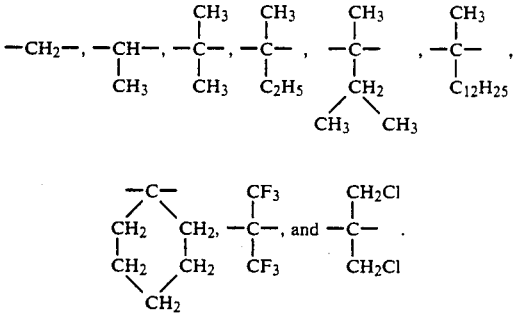

16. The silver halide color photographic material as claimed in claim 1, wherein at least one photographic layer comprises a silver halide emulsion containing 90 mol % or more of silver chloride.

17. The silver halide color photographic material as claimed in claim 1, wherein the amount of the epoxy compound represented by formula (I) to be added is 0.001 to 10 g per $m^2$ of the silver halide color photographic material.

18. The silver halide color photographic material as claimed in claim 1, wherein the amount of the dye-forming coupler to be added is 0.1 to 1.0 mol per mol of silver halide contained in a silver halide emulsion layer constituting the photosensitive layer.

19. A silver halide color photographic material which comprises in at least one photographic layer on a base at least one compound selected from the group consisting of sparingly water-soluble epoxy compound represented by formula (II) given below and a dye-forming coupler:

Formula (II)

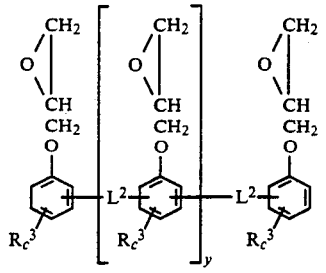

wherein each $R^3$ represents an alkyl group or a halogen atom, each $L^2$ represents a divalent aliphatic organic group, c is an integer of 0 to 4, and y is a real number of 0 to 20.

20. The silver halide color photographic material as claimed in claim 19, wherein the dye-forming coupler is a cyan coupler represented by the following formula (IV):

Formula (IV)

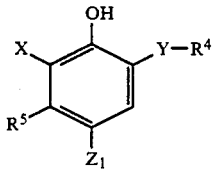

wherein Y represents —NHCO— or —CONH—, $R^4$ represents an aliphatic group, an aromatic group, a heterocyclic group, or an amino group, X represents a hydrogen atom, a halogen atom, an alkoxy group, or an acylamino group, $R^5$ represents an alkyl group or an acylamino group, or $R^5$ represents a group of non-metallic atoms required to form a 5- to 7-membered ring by bonding with X, and $Z_1$ represents a hydrogen atom or a group capable of being released upon coupling reaction with the oxidized product of a color-developing agent.

21. The silver halide color photographic material as claimed in claim 19, wherein the dye-forming coupler is a cyan coupler represented by the following formula (IVa):

Formula (IVa)

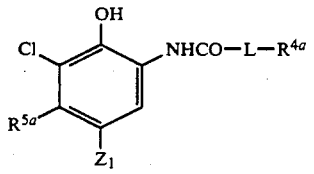

wherein $R^{4a}$ represents an alkyl group having at least 7 carbon atoms, $R^{5a}$ represents an alkyl group having 2 to 15 carbon atoms, L represents a mere bond or a divalent linking group, and $Z_1$ represents a hydrogen atom or a group capable of being released upon a coupling reaction with the oxidized product of a color-developing agent.

22. The silver halide color photographic material as claimed in claim 21, wherein $R^{4a}$ in formula (IVa) represents an octyl group, a tert-octyl group, a tridecyl group, a pentadecyl group, or an eicosyl group.

23. The silver halide color photographic material as claimed in claim 21, wherein L in formula (IVa) represents a divalent linking group is selected from the group consisting of an alkylene linkage, a phenylene linkage, an ether linkage, a carbonamido linkage, a sulfonamido linkage, an ester linkage, and a urethane linkage, and a divalent group formed by combining these groups.

24. The silver halide color photographic material as claimed in claim 21, wherein $R^{5a}$ in formula (IVa) represents an ethyl group, a butyl group, a tert-butyl group, a cyclohexyl group, or a pentadecyl group.

25. The silver halide color photographic material as claimed in claim 21, wherein $Z_1$ in formula (IVa) represents a hydrogen atom, a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group, or an aromatic azo group, which may contain a photographically useful group.

26. The silver halide color photographic material as claimed in claim 21, wherein $R^{4a}$ in formula (IVa) is an alkyl group having 10–22 carbon atoms.

27. The silver halide color photographic material as claimed in claim 21, wherein $R^{5a}$ in formula (IVa) is an alkyl group having 2–15 carbon atoms.

28. The silver halide color photographic material as claimed in claim 19, wherein the dye-forming coupler is a yellow coupler represented by the following formula (V):

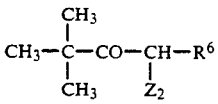

Formula (V)

wherein $R^6$ represents an N-arylcarbamoyl group and $Z_2$ represents a group capable of being released upon coupling reaction with the oxidized product of an aromatic primary amine color-developing agent.

29. The silver halide color photographic material as claimed in claim 19, wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and non-photosensitive hydrophilic colloid layers are provided on a base, and at least one of said silver halide emulsion layers contains at least one compound selected from the group consisting of sparingly water-soluble epoxy compounds represented by formula (II).

30. The silver halide color photographic material as claimed in claim 19, wherein a photosensitive silver halide emulsion layer containing a yellow dye-forming coupler, a photosensitive silver halide emulsion layer containing a magenta dye-forming coupler, a photosensitive silver halide emulsion layer containing a cyan dye-forming coupler, and non-photosensitive hydrophilic colloid layers are provided on a base, and at least one of said nonphotosensitive hydrophilic colloid layers contains at least one compound selected from the group consisting of sparingly water-soluble epoxy compounds represented by formula (II).

31. The silver halide color photographic material as claimed in claim 30, wherein the dye-forming coupler is a compound represented by the formula (IVa):

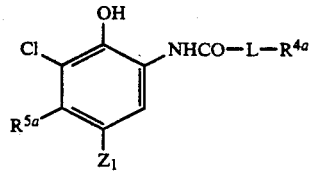

Formula (IVa)

wherein $R^{4a}$ represents an alkyl group having at least 7 carbon atoms, $R^{5a}$ represents an alkyl group having 2 to 15 carbon atoms, L represents a mere bond or a divalent linking group, and $Z_1$ represents a hydrogen atom or a group capable of being released upon a coupling reaction with the oxidized product of a color developing agent.

32. The silver halide color photographic material as claimed in claim 19, wherein the solubility in water at 25° C. of the epoxy compound represented by formula (II) is 10% or below.

33. The silver halide color photographic material as claimed in claim 19, wherein $L^2$ in the epoxy compound represented by formula (II) is selected from the group consisting of

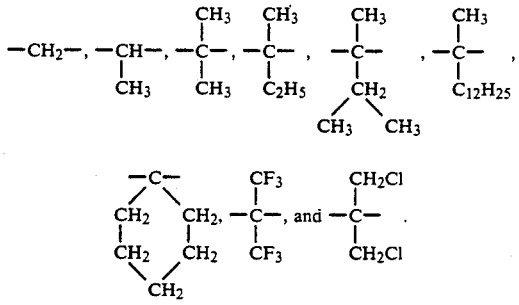

34. The silver halide color photographic material as claimed in claim 19, wherein at least one photographic layer comprises a silver halide emulsion containing 90 mol % or more of silver chloride.

35. The silver halide color photographic material as claimed in claim 19, wherein the amount of the epoxy compound represented by formula (II) to be added is 0.001 to 10 g per $m^2$ of the silver halide color photographic material.

36. The silver halide color photographic material as claimed in claim 19, wherein the amount of the dye-forming coupler to be added is 0.1 to 1.0 mol per mol of silver halide contained in a silver halide emulsion layer constituting the photosensitive layer.

* * * * *